US010710769B2

(12) United States Patent
Hawley et al.

(10) Patent No.: US 10,710,769 B2
(45) **Date of Patent: *Jul. 14, 2020**

(54) COMPOSITE PALLET

(71) Applicant: INTEGRATED COMPOSITE PRODUCTS, INC., Rochester, MN (US)

(72) Inventors: Ronald Clare Hawley, Winona, MN (US); Derek Joel Mazula, Sioux Falls, SD (US)

(73) Assignee: Integrated Composite Products, Inc., Rochester, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/665,950

(22) Filed: Oct. 28, 2019

(65) Prior Publication Data

US 2020/0062446 A1 Feb. 27, 2020

Related U.S. Application Data

(63) Continuation of application No. 15/882,535, filed on Jan. 29, 2018, now Pat. No. 10,457,442.

(Continued)

(51) Int. Cl.
*B65D 19/38* (2006.01)
*B65D 19/00* (2006.01)

(52) U.S. Cl.
CPC ..... *B65D 19/0095* (2013.01); *B65D 2519/00034* (2013.01); *B65D 2519/00069* (2013.01);

(Continued)

(58) Field of Classification Search
CPC ..... B65D 19/00; B65D 19/0095

(Continued)

(56) References Cited

U.S. PATENT DOCUMENTS 6,745,703 B2 6/2004 Torrey et al.
7,487,730 B2 2/2009 Hedstrom (Continued)

FOREIGN PATENT DOCUMENTS

CN 201165387 A1 12/2008
DE 2057361 A1 6/1971

(Continued)

OTHER PUBLICATIONS

International Search Report and Written Opinion dated May 4, 2018 for International Application No. PCT/US2018/015741 (13 pgs).

*Primary Examiner* — Matthew W Ing
(74) *Attorney, Agent, or Firm* — Seager, Tufte & Wickhem, LLP

(57) ABSTRACT

A pallet may include a base layer, an intermediate layer, two or more support blocks, and a top layer. The support blocks may be removably attached to the base layer and the intermediate layer such that the support blocks are positioned between the base layer and the intermediate layer. The base layer may include two or more base members, the intermediate layer may include two or more intermediate members and the top layer may include two top outside members, which all may be described as structural members. The structural members may include two or more ribs, may include fiber dispersed in a thermoplastic material, and may include a continuous fiber bundle within each rib.

20 Claims, 13 Drawing Sheets

Related U.S. Application Data

(60) Provisional application No. 62/452,159, filed on Jan. 30, 2017.

(52) U.S. Cl.
CPC ..... *B65D 2519/0086* (2013.01); *B65D 2519/0099* (2013.01); *B65D 2519/00104* (2013.01); *B65D 2519/00273* (2013.01); *B65D 2519/00293* (2013.01); *B65D 2519/00323* (2013.01); *B65D 2519/00333* (2013.01); *B65D 2519/00407* (2013.01); *B65D 2519/00412* (2013.01); *B65D 2519/00417* (2013.01); *B65D 2519/00567* (2013.01); *B65D 2519/00572* (2013.01); *B65D 2519/00796* (2013.01)

(58) Field of Classification Search
USPC ..... 108/57.25
See application file for complete search history.

(56) References Cited

U.S. PATENT DOCUMENTS

| | | | | |
|---|---|---|---|---|
| 7,516,705 | B2 | 4/2009 | Hedstrom | |
| 7,779,764 | B2 | 8/2010 | Naidu et al. | |
| 7,874,256 | B2 | 1/2011 | Muirhead | |
| 7,878,127 | B2 | 2/2011 | Hedstrom | |
| 8,006,629 | B2 | 8/2011 | Naidu | |
| 8,141,500 | B2 | 3/2012 | Naidu et al. | |
| 8,627,773 | B2 | 1/2014 | Storteboom et al. | |
| 8,667,905 | B2 | 3/2014 | Anderson et al. | |
| 8,800,456 | B2 | 8/2014 | Storteboom et al. | |
| 8,850,993 | B2 | 10/2014 | Storteboom et al. | |
| 9,340,320 | B2 | 5/2016 | Brandt et al. | |
| 9,352,876 | B2 | 5/2016 | Muirhead | |
| 9,409,673 | B2 | 8/2016 | Brandt et al. | |
| 9,434,506 | B2 | 9/2016 | Takyar | |
| 9,745,098 | B2 | 8/2017 | Takyar et al. | |
| 9,776,762 | B2 | 10/2017 | De Beer et al. | |
| D824,133 | S | 7/2018 | Hawley et al. | |
| 2005/0056193 | A1 | 3/2005 | Laender et al. | |
| 2010/0288169 | A1* | 11/2010 | Du Toit | B65D 19/0004 108/57.25 |
| 2013/0145971 | A1 | 6/2013 | Federl et al. | |
| 2015/0151506 | A1* | 6/2015 | Hawley | B29C 45/0005 428/141 |
| 2015/0274358 | A1* | 10/2015 | Hidalgo | B65D 19/0095 108/56.3 |
| 2015/0360809 | A1* | 12/2015 | McBride | B65D 19/0095 108/57.19 |
| 2017/0232703 | A1 | 8/2017 | Hawley et al. | |
| 2018/0043643 | A1 | 2/2018 | Hawley et al. | |
| 2018/0215505 | A1 | 8/2018 | Hawley et al. | |

FOREIGN PATENT DOCUMENTS

| | | | |
|---|---|---|---|
| DE | 2733456 | A1 | 2/1979 |
| GB | 1388759 | A | 3/1975 |
| WO | 9733798 | A1 | 9/1997 |
| WO | 2016130784 | A1 | 8/2016 |

* cited by examiner

COMPOSITE PALLET

CROSS-REFERENCE TO RELATED APPLICATIONS

This application is a continuation of U.S. application Ser. No. 15/882,535, filed Jan. 29, 2018 which claims priority to U.S. Provisional Application Ser. No. 62/452,159, filed Jan. 30, 2017, the entirety of which is incorporated herein by reference.

BACKGROUND

The present disclosure relates generally to composite pallets that may provide a robust loading surface and may be readily assembled and disassembled to help simplify repairs. Current pallet options are often not able to be disassembled and may require "complex repairs" (e.g., breaking components, glue, welds, etc.). For example, wood pallets may be assembled using nails such that removal of the nails for disassembly of the pallet may be difficult and may produce nail holes that make reassembly also difficult. Also, for example, typical composite pallets may be completely fused together to eliminate the use of multiple parts such that disassembly may be almost impossible without damaging the composite pallet. It may be desirable to produce a pallet that is configured to be readily assembled and disassembled, while maintaining rigidity and durability.

SUMMARY

The present disclosure relates to a pallet including multiple structural members with fiber dispersed in a thermoplastic material and fiber reinforcing members located within ribs of the structural member. Each structural member may be specifically engineered (e.g., with injection molding, base molding compound thermoplastic resin selection (e.g., polypropylene, high density polyethylene, nylon, etc.) base molding compound thermoplastic fiber concentrations, fiber type (long fiber, short fiber, etc.) dispersion, continuous fiber bundles within ribs, continuous fiber meshes, other features, etc.) to serve a purpose within the pallet. In other words, each structural member may be selectively reinforced in such a way to enhance performance when coupled with a specifically formulated base molding compound. For example, the multiple structural members may include base members, intermediate members, and top outside members that each contribute to the complete pallet assembly and provide specifically tailored characteristics to appropriately reinforce the complete pallet assembly. Further, the pallet includes support blocks that couple to the structural members and provide separation between the structural members. Each of the components of the pallet may be easily attached to and removed from one another to provide improved ability to repair the complete pallet and components thereof.

In one aspect, an exemplary pallet may include a base layer, an intermediate layer, two or more thermoplastic support blocks, and a top layer. The base layer may include two or more thermoplastic base members. Each thermoplastic base member of the two or more thermoplastic base members may define a first surface and a second surface opposing the first surface and each thermoplastic base member of the two or more thermoplastic base members may extend between a first end and a second end. The intermediate layer may include two or more thermoplastic intermediate members. Each thermoplastic intermediate member of the two or more thermoplastic intermediate members may define a first surface and a second surface opposing the first surface and each thermoplastic intermediate member of the two or more thermoplastic intermediate members may extend between a first end and a second end.

The two or more thermoplastic support blocks may be removably attached to the base layer proximate the first surfaces of the two or more thermoplastic base members and may be removably attached to the intermediate layer proximate the second surfaces of the two or more thermoplastic intermediate members such that the two or more thermoplastic support blocks may be positioned between the base layer and the intermediate layer. The two or more thermoplastic support blocks may separate the base layer from the intermediate layer. The top layer may include two thermoplastic top outside members removably attached to the intermediate layer proximate the first surfaces of the two or more thermoplastic intermediate members. Each thermoplastic top outside member of the two thermoplastic top outside members may define a first surface and a second surface opposing the first surface and each thermoplastic top outside member of the two thermoplastic top outside members may extend between a first end and a second end.

The two or more thermoplastic base members, the two or more thermoplastic intermediate members, and the two thermoplastic top outside members may be described as thermoplastic structural members. Each thermoplastic structural member may include two or more ribs extending away from the second surface to a rib end portion between the first and second ends of the thermoplastic structural member. Each thermoplastic structural member may include fiber dispersed in a thermoplastic material and each of the two or more ribs of the thermoplastic structural member may include a continuous fiber bundle within each rib proximate the rib end portion.

In another aspect, an exemplary kit may include two or more thermoplastic base members, two or more thermoplastic intermediate members, two or more thermoplastic support blocks, and fasteners. Each thermoplastic base member of the two or more thermoplastic base members may define a first surface and a second surface opposing the first surface and each thermoplastic base member of the two or more thermoplastic base members may extend between a first end and a second end. Each thermoplastic intermediate member of the two or more thermoplastic intermediate members may define a first surface and a second surface opposing the first surface. Each thermoplastic intermediate member of the two or more thermoplastic intermediate members may extend between a first end and a second end and may include two or more ribs extending away from the second surface to a rib end portion between the first and second end of the thermoplastic intermediate member. Each thermoplastic intermediate member may include fiber dispersed in a thermoplastic material and each of the two or more ribs of the thermoplastic intermediate member may include a continuous fiber bundle within each rib proximate the rib end portion. Each thermoplastic intermediate member of the two or more thermoplastic intermediate members may define recesses proximate the second surface of each thermoplastic intermediate member.

The two or more thermoplastic support blocks may be configured to be removably attached to the two or more thermoplastic base members and the two or more thermoplastic intermediate members. The two or more thermoplastic support blocks may be configured to separate the two or more thermoplastic base members from the two or more thermoplastic intermediate members. The two or more thermoplastic support blocks may include protrusions configured to be received by the recesses of the two or more thermoplastic intermediate members. The fasteners may be configured to removably attach the two or more thermoplastic base members to the two or more thermoplastic support blocks, to removably attach the two or more thermoplastic intermediate members to the two or more thermoplastic support blocks, and to removably attach the two thermoplastic top outside members to the two or more thermoplastic intermediate members.

In yet another aspect, an exemplary pallet may include a plurality of thermoplastic structural members and two or more thermoplastic support blocks. Each thermoplastic structural member of the plurality of thermoplastic structural members may define a first surface and a second surface opposing the first surface. Each of the plurality of thermoplastic structural members may extend between a first end and a second end and may include two or more ribs extending away from the second surface to a rib end portion between the first and second end of each thermoplastic structural member. Each thermoplastic structural member may include fiber dispersed in a thermoplastic material and each of the two or more ribs of the thermoplastic structural member may include a continuous fiber bundle within each rib proximate the rib end portion.

The two or more thermoplastic support blocks may be removably attached to the plurality of thermoplastic structural members such that the blocks may separate a first portion of the plurality of thermoplastic structural members from a second portion of the plurality of thermoplastic structural members. The two or more thermoplastic support blocks, the first portion of the plurality of thermoplastic structural members, and the second portion of the plurality of thermoplastic structural members may define at least two discrete openings for inserting a lifting tool.

A pallet is disclosed. The pallet comprises: a base layer comprising two or more thermoplastic base members, wherein each thermoplastic base member of the two or more thermoplastic base members defines a first surface and a second surface opposing the first surface, wherein each thermoplastic base member of the two or more thermoplastic base members extends between a first end and a second end; an intermediate layer comprising two or more thermoplastic intermediate members, wherein each thermoplastic intermediate member of the two or more thermoplastic intermediate members defines a first surface and a second surface opposing the first surface, wherein each thermoplastic intermediate member of the two or more thermoplastic intermediate members extends between a first end and a second end; two or more thermoplastic support blocks removably attached to the base layer proximate the first surfaces of the two or more thermoplastic base members and removably attached to the intermediate layer proximate the second surfaces of the two or more thermoplastic intermediate members such that the two or more thermoplastic support blocks are positioned between the base layer and the intermediate layer, wherein the two or more thermoplastic support blocks separate the base layer from the intermediate layer; and a top layer comprising two thermoplastic top outside members removably attached to the intermediate layer proximate the first surfaces of the two or more thermoplastic intermediate members, wherein each thermoplastic top outside member of the two thermoplastic top outside members defines a first surface and a second surface opposing the first surface, wherein each thermoplastic top outside member of the two thermoplastic top outside members extends between a first end and a second end, wherein the two or more thermoplastic base members, the two or more thermoplastic intermediate members, and the two thermoplastic top outside members are thermoplastic structural members, wherein each thermoplastic structural member comprises two or more ribs extending away from the second surface to a rib end portion between the first and second ends of the thermoplastic structural member, wherein each thermoplastic structural member comprises fiber dispersed in a thermoplastic material and each of the two or more ribs of the thermoplastic structural member comprises a continuous fiber bundle within each rib proximate the rib end portion.

Alternatively or additionally to any of the embodiments above, each thermoplastic intermediate member of the two or more thermoplastic intermediate members comprises an open mesh proximate the first surface.

Alternatively or additionally to any of the embodiments above, the top layer comprises one or more top middle members positioned between the two thermoplastic top outside members, wherein each of the one or more top middle members defines a first surface and a second surface opposing the first surface, wherein each of the one or more top middle members extends between a first end and a second end, wherein the one or more top middle members are removably attached to the intermediate layer such that the second surface of the one or more top middle members is proximate the first surfaces of the two or more thermoplastic intermediate members.

Alternatively or additionally to any of the embodiments above, the structural members and the two or more thermoplastic support blocks comprise a non-halogenated, non-brominated food-contact-safe fire retardant.

Alternatively or additionally to any of the embodiments above, the two or more thermoplastic base members are coplanar such that the first surfaces of each of the thermoplastic base members are coplanar.

Alternatively or additionally to any of the embodiments above, the two or more ribs of each thermoplastic structural member comprise four ribs that are parallel to and equidistant from one another.

Alternatively or additionally to any of the embodiments above, the two or more thermoplastic support blocks are removably attached to both of the base layer and the intermediate layer using fasteners, such as screws.

Alternatively or additionally to any of the embodiments above, the continuous fiber bundle comprises at least 1000 continuous fibers dispersed in a thermoplastic material.

Alternatively or additionally to any of the embodiments above, at least one thermoplastic support block of the two or more thermoplastic support blocks couples two thermoplastic base members of the two or more thermoplastic base members together.

Alternatively or additionally to any of the embodiments above, the thermoplastic structural members comprise a first thermoplastic material and the two or more support blocks comprise a second thermoplastic material and the first thermoplastic material is a different type of thermoplastic material than the second thermoplastic material.

Alternatively or additionally to any of the embodiments above, each of the thermoplastic structural members comprises polyolefin, such as polypropylene, wherein the two or more support blocks comprise a polyolefin, such as polyethylene or high-density polyethylene.

Alternatively or additionally to any of the embodiments above, the base layer, the two or more support blocks, and the top layer define at least two discrete openings for inserting a lifting tool, such as a mechanically assisted lifting device.

Alternatively or additionally to any of the embodiments above, the two or more thermoplastic support blocks comprise protrusions and the two or more thermoplastic intermediate members comprise recesses such that the protrusions are received by the recesses to position or align or mate the two or more thermoplastic intermediate members relative to the two or more thermoplastic support blocks.

Alternatively or additionally to any of the embodiments above, the two or more thermoplastic intermediate members comprise two thermoplastic intermediate outside members and one or more thermoplastic intermediate inside member, wherein the two or more thermoplastic support blocks comprise corner blocks, center blocks, and middle blocks, wherein the middle blocks are positioned proximate a center point of each thermoplastic intermediate member, wherein the corner blocks are positioned proximate the first and second ends of each of the two thermoplastic intermediate outside members, and wherein the center blocks are positioned proximate the first and second ends of the one or more thermoplastic intermediate inside member.

Alternatively or additionally to any of the embodiments above, each thermoplastic support block of the two or more thermoplastic support blocks defines a first surface proximate the intermediate layer and a second surface proximate the base layer, wherein a portion of the two or more thermoplastic support blocks comprise an alignment wall extending from the first surface of the thermoplastic support block, wherein the alignment wall aligns a thermoplastic intermediate member on a thermoplastic support block and contacts the top layer.

Alternatively or additionally to any of the embodiments above, the two or more thermoplastic support blocks comprise corner blocks, center blocks, and middle blocks, wherein each thermoplastic support block of the two or more thermoplastic support blocks defines a first surface proximate the intermediate layer and a second surface proximate the base layer, wherein the center blocks comprise two alignment walls extending from the first surface of the center block, wherein the first end of a thermoplastic intermediate member is positioned on the first surface of a first center block of the center blocks between the two alignment walls and the second end of a thermoplastic intermediate member is positioned on the first surface of a second center block of the center blocks between the two alignment walls.

Alternatively or additionally to any of the embodiments above, each of the two or more thermoplastic support blocks, the base layer, and the intermediate layer defines fastener apertures through which fasteners are inserted to removably attach the two or more thermoplastic support blocks to the base layer and to removably attach the two or more thermoplastic support blocks to the intermediate layer.

Alternatively or additionally to any of the embodiments above, each thermoplastic support block of the two or more thermoplastic support blocks defines a first surface proximate the intermediate layer and a second surface proximate the base layer, wherein each thermoplastic support block comprises support ribs for at least a portion between the first and second surfaces of each thermoplastic support block.

Alternatively or additionally to any of the embodiments above, the two or more thermoplastic intermediate members comprise protrusions extending from the first surface of each of the two or more thermoplastic intermediate members and the one or more top middle members defines recesses proximate the second surface of each of the one or more top middle members, wherein the protrusions of the two or more thermoplastic intermediate members are received by the recesses of the one or more top middle members.

A kit for assembling a pallet is disclosed. The kit comprises: two or more thermoplastic base members, wherein each thermoplastic base member of the two or more thermoplastic base members defines a first surface and a second surface opposing the first surface, wherein each thermoplastic base member of the two or more thermoplastic base members extends between a first end and a second end; two or more thermoplastic intermediate members, wherein each thermoplastic intermediate member of the two or more thermoplastic intermediate members defines a first surface and a second surface opposing the first surface, wherein each thermoplastic intermediate member of the two or more thermoplastic intermediate members extends between a first end and a second end and comprises two or more ribs extending away from the second surface to a rib end portion between the first and second end of the thermoplastic intermediate member, wherein each thermoplastic intermediate member comprises fiber dispersed in a thermoplastic material and each of the two or more ribs of the thermoplastic intermediate member comprises a continuous fiber bundle within each rib proximate the rib end portion, wherein each thermoplastic intermediate member of the two or more thermoplastic intermediate members defines recesses proximate the second surface of each thermoplastic intermediate member; two or more thermoplastic support blocks configured to be removably attached to the two or more thermoplastic base members and the two or more thermoplastic intermediate members, wherein the two or more thermoplastic support blocks are configured to separate the two or more thermoplastic base members from the two or more thermoplastic intermediate members, wherein the two or more thermoplastic support blocks comprise protrusions configured to be received by the recesses of the two or more thermoplastic intermediate members; and fasteners configured to removably attach the two or more thermoplastic base members to the two or more thermoplastic support blocks, to removably attach the two or more thermoplastic intermediate members to the two or more thermoplastic support blocks, and to removably attach the two thermoplastic top outside members to the two or more thermoplastic intermediate members.

Alternatively or additionally to any of the embodiments above, each thermoplastic intermediate member of the two or more thermoplastic intermediate members comprises an open mesh proximate the first surface.

Alternatively or additionally to any of the embodiments above, further comprising two thermoplastic top outside members configured to be removably attached to the two or more thermoplastic intermediate members proximate the first surfaces of the two or more thermoplastic intermediate members, wherein each thermoplastic top outside member of the two thermoplastic top outside members defines a first surface and a second surface opposing the first surface, wherein each thermoplastic top outside member of the two thermoplastic top outside members extends between a first end and a second end.

Alternatively or additionally to any of the embodiments above, further comprising one or more top middle members positioned between the two thermoplastic top outside members, wherein each of the one or more top middle members defines a first surface and a second surface opposing the first surface, wherein each of the one or more top middle members extends between a first end and a second end, wherein the one or more top middle members are configured to be removably attached to the two or more thermoplastic intermediate members such that the second surface of the one or more top middle members is proximate the first surfaces of the two or more thermoplastic intermediate members.

Alternatively or additionally to any of the embodiments above, the two or more thermoplastic base members, the two or more thermoplastic intermediate members, and the two or more support blocks comprise a non-halogenated, non-brominated food-contact-safe fire retardant.

Alternatively or additionally to any of the embodiments above, the two or more thermoplastic base members are coplanar such that the first surfaces of each of the thermoplastic base members are coplanar.

Alternatively or additionally to any of the embodiments above, the two or more ribs of each thermoplastic intermediate member comprise four ribs that are parallel to and equidistant from one another.

Alternatively or additionally to any of the embodiments above, the continuous fiber bundle comprises at least 1000 continuous fibers dispersed in a thermoplastic material.

Alternatively or additionally to any of the embodiments above, at least one thermoplastic support block of the two or more thermoplastic support blocks couples two thermoplastic base members of the two or more thermoplastic base members together.

Alternatively or additionally to any of the embodiments above, the thermoplastic intermediate members comprise a first thermoplastic material and the two or more support blocks comprise a second thermoplastic material and the first thermoplastic material is a different type of thermoplastic material than the second thermoplastic material.

Alternatively or additionally to any of the embodiments above, each of the thermoplastic intermediate members comprises polyolefin, such as polypropylene, wherein the two or more support blocks comprise a polyolefin, such as polyethylene or high-density polyethylene.

Alternatively or additionally to any of the embodiments above, the two or more base members, the two or more support blocks, and the top outside members define at least two discrete openings for inserting a lifting tool, such as a mechanically assisted lifting device.

Alternatively or additionally to any of the embodiments above, the two or more thermoplastic support blocks comprise protrusions and the two or more thermoplastic intermediate members comprise recesses such that the protrusions are received by the recesses to position or align or mate the two or more thermoplastic intermediate members relative to the two or more thermoplastic support blocks.

Alternatively or additionally to any of the embodiments above, the two or more thermoplastic intermediate members comprise two thermoplastic intermediate outside members and one or more thermoplastic intermediate inside member, wherein the two or more thermoplastic support blocks comprise corner blocks, center blocks, and middle blocks, wherein the middle blocks are positioned proximate a center point of each thermoplastic intermediate member, wherein the corner blocks are positioned proximate the first and second ends of each of the two thermoplastic intermediate outside members, and wherein the center blocks are positioned proximate the first and second ends of the one or more thermoplastic intermediate inside member.

Alternatively or additionally to any of the embodiments above, each thermoplastic support block of the two or more thermoplastic support blocks defines a first surface proximate the intermediate members and a second surface proximate the base members, wherein a portion of the two or more thermoplastic support blocks comprise an alignment wall extending from the first surface of the thermoplastic support block, wherein the alignment wall is configured to align a thermoplastic intermediate member on a thermoplastic support block and configured to contact the top outside members.

Alternatively or additionally to any of the embodiments above, the two or more thermoplastic support blocks comprise corner blocks, center blocks, and middle blocks, wherein each thermoplastic support block of the two or more thermoplastic support blocks defines a first surface proximate the intermediate members and a second surface proximate the base members, wherein the center blocks comprise two alignment walls extending from the first surface of the center block, wherein the first end of a thermoplastic intermediate member is positioned on the first surface of a first center block of the center blocks between the two alignment walls and the second end of a thermoplastic intermediate member is positioned on the first surface of a second center block of the center blocks between the two alignment walls.

Alternatively or additionally to any of the embodiments above, each of the two or more thermoplastic support blocks, the base members, and the intermediate members defines fastener apertures through which fasteners are inserted to removably attach the two or more thermoplastic support blocks to the base members and to removably attach the two or more thermoplastic support blocks to the intermediate members.

Alternatively or additionally to any of the embodiments above, each thermoplastic support block of the two or more thermoplastic support blocks defines a first surface proximate the intermediate members and a second surface proximate the base members, wherein each thermoplastic support block comprises support ribs for at least a portion between the first and second surfaces of each thermoplastic support block.

Alternatively or additionally to any of the embodiments above, the two or more thermoplastic intermediate members comprise protrusions extending from the first surface of each of the two or more thermoplastic intermediate members and the one or more top middle members defines recesses proximate the second surface of each of the one or more top middle members, wherein the protrusions of the two or more thermoplastic intermediate members are received by the recesses of the one or more top middle members.

A pallet is disclosed. The pallet comprises: a plurality of thermoplastic structural members, wherein each thermoplastic structural member of the plurality of thermoplastic structural members defines a first surface and a second surface opposing the first surface, wherein each of the plurality of thermoplastic structural members extends between a first end and a second end and comprises two or more ribs extending away from the second surface to a rib end portion between the first and second end of each thermoplastic structural member, wherein each thermoplastic structural member comprises fiber dispersed in a thermoplastic material and each of the two or more ribs of the thermoplastic structural member comprises a continuous fiber bundle within each rib proximate the rib end portion; and two or more thermoplastic support blocks removably attached to the plurality of thermoplastic structural members such that the blocks separate a first portion of the plurality of thermoplastic structural members from a second portion of the plurality of thermoplastic structural members, wherein the two or more thermoplastic support blocks, the first portion of the plurality of thermoplastic structural members, and the second portion of the plurality of thermoplastic structural members define at least two discrete openings for inserting a lifting tool.

Alternatively or additionally to any of the embodiments above, the second portion of the plurality of thermoplastic structural members are coupled to define a parallelogram shape, wherein a thermoplastic support block of the two or more thermoplastic support blocks is positioned on each corner of the parallelogram shape and at each midpoint between each corner of the parallelogram shape.

Alternatively or additionally to any of the embodiments above, each thermoplastic structural member of the plurality of thermoplastic structural members comprises an open mesh proximate the first or second surface.

Alternatively or additionally to any of the embodiments above, the structural members and the two or more thermoplastic support blocks comprise a non-halogenated, non-brominated food-contact-safe fire retardant.

Alternatively or additionally to any of the embodiments above, the two or more ribs of each thermoplastic structural member comprise four ribs that are parallel to and equidistant from one another.

Alternatively or additionally to any of the embodiments above, the two or more thermoplastic support blocks are removably attached to the plurality of thermoplastic structural members using fasteners, such as screws.

Alternatively or additionally to any of the embodiments above, the continuous fiber bundle comprises at least 1000 continuous fibers dispersed in a thermoplastic material.

Alternatively or additionally to any of the embodiments above, the thermoplastic structural members comprise a first thermoplastic material and the two or more support blocks comprise a second thermoplastic material and the first thermoplastic material is a different type of thermoplastic material than the second thermoplastic material.

Alternatively or additionally to any of the embodiments above, each of the thermoplastic structural members comprises polyolefin, such as polypropylene, wherein the two or more support blocks comprise a polyolefin, such as polyethylene or high-density polyethylene.

Alternatively or additionally to any of the embodiments above, the plurality of thermoplastic structural members and the two or more support blocks define at least two discrete openings for inserting a lifting tool, such as a mechanically assisted lifting device.

Alternatively or additionally to any of the embodiments above, the two or more thermoplastic support blocks comprise protrusions and the plurality of thermoplastic structural members comprise recesses such that the protrusions are received by the recesses to position or align or mate the plurality of thermoplastic structural members relative to the two or more thermoplastic support blocks.

Alternatively or additionally to any of the embodiments above, each thermoplastic support block of the two or more thermoplastic support blocks defines a first surface proximate the first portion of thermoplastic structural members and a second surface proximate the second portion of thermoplastic structural members, wherein a portion of the two or more thermoplastic support blocks comprise an alignment wall extending from the first surface of the thermoplastic support block, wherein the alignment wall aligns the first portion of thermoplastic structural members.

Alternatively or additionally to any of the embodiments above, each of the two or more thermoplastic support blocks and the plurality of thermoplastic structural members defines fastener apertures through which fasteners are inserted to removably attach the two or more thermoplastic support blocks to the plurality of thermoplastic structural members.

Alternatively or additionally to any of the embodiments above, each thermoplastic support block of the two or more thermoplastic support blocks defines a first surface proximate the first portion of the plurality of thermoplastic structural members and a second surface proximate the second portion of thermoplastic structural members, wherein each thermoplastic support block comprises support ribs for at least a portion between the first and second surfaces of each thermoplastic support block.

These and various other features and advantages will be apparent from a reading of the following detailed description.

BRIEF DESCRIPTION OF THE DRAWINGS

The disclosure may be more completely understood in consideration of the following detailed description of various embodiments of the disclosure in connection with the accompanying drawings, in which.

DETAILED DESCRIPTION

Figure 1:
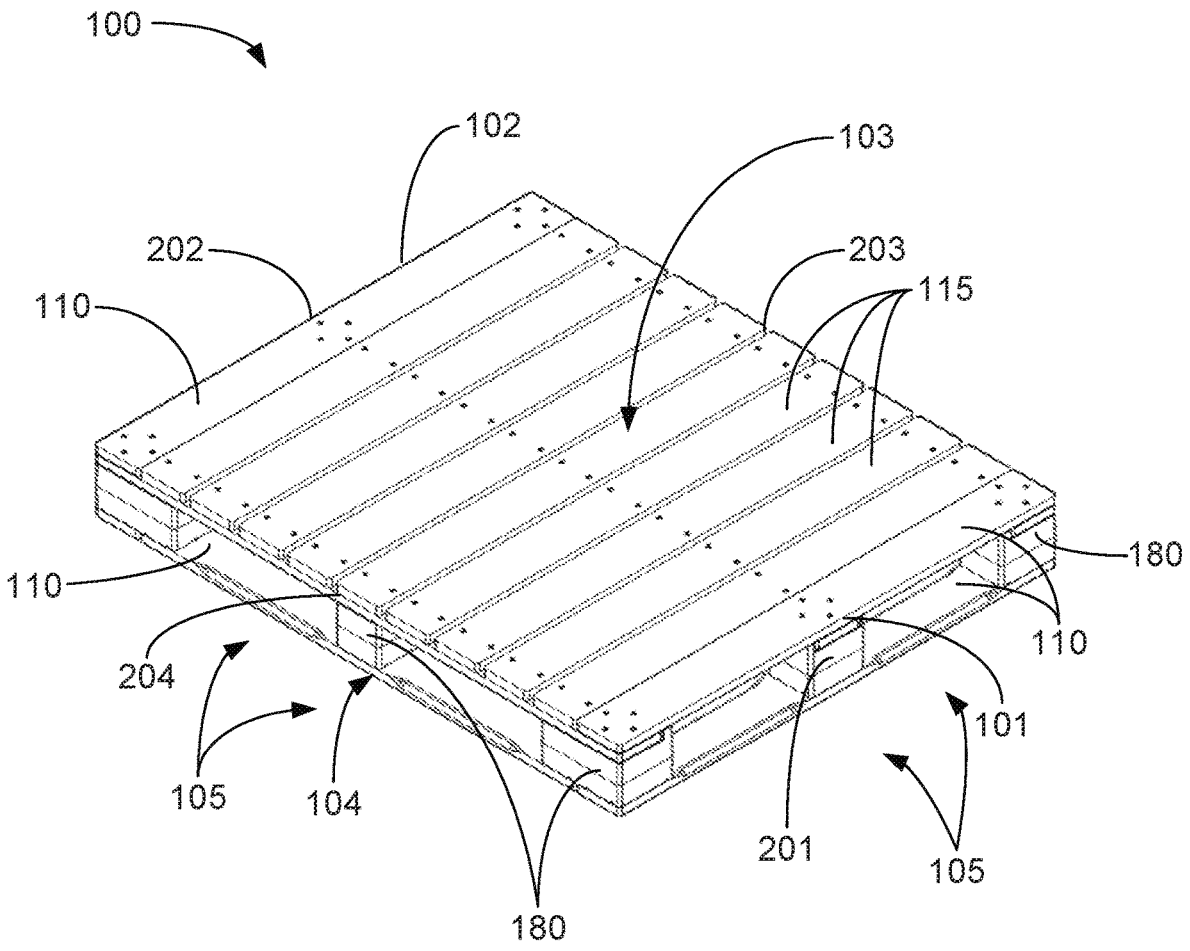
FIG. 1 is a perspective view of an exemplary pallet in assembled form.

In the following detailed description, reference is made to the accompanying drawings that form a part hereof, and in which are shown by way of illustration several specific embodiments. It is to be understood that other embodiments are contemplated and may be made without departing from the scope or spirit of the present disclosure. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the properties sought to be obtained by those skilled in the art utilizing the teachings disclosed herein.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

It should be noted that "top" and "bottom" (or other terms like "upper" and "lower" or "first" and "second") are utilized strictly for relative descriptions and do not imply any overall orientation of the article in which the described element is located.

The present disclosure provides selectively reinforced structural members that are combined to assemble a pallet that may be disassembled and reassembled easily and readily (e.g., to make repairs to individual components such as structural members or support blocks). Each of the structural members may be selectively reinforced using fiber dispersed in thermoplastic material, positioning continuous fiber bundles in ribs of the structural member, and/or including an open mesh. Various combinations of these reinforcements may be used in various different types of structural members. Further, the structural members may be selectively reinforced in any other suitable way.

Providing selective reinforcements in the structural members that are used to assemble a pallet may improve the structural properties while reducing the weight, failure points, and/or cost of the composite structural member. The selective reinforcements may be placed strategically within the structural members to provide improved performance (e.g., flexural strength, modulus, impact, durability, etc.) at specific locations. For example, a continuous fiber bundle positioned within the structural member may provide an increased tensile strength to each of the structural members such that the pallet assembly may be lifted or a payload disposed thereon while maintaining structural strength.

Constructing a pallet from selectively reinforced structural members also provides the opportunity for the individual structural members to be easily replaced (in addition to the individual structural members being independently engineered to serve specific purposes that may include flexural strength, modulus, impact, durability, load bearing, etc.). Contrarily, with regards to conventional composite pallets, the pallet is fused together in, e.g., one, two, three pieces (or a small number of parts that may be welded, glued, or semi-permanently bonded), making it nearly impossible to disassemble or repair, which may be described as complex repairs. In other words, to repair conventional composite pallets, a component (that may be effectively a group of components that may be bonded together) of the pallet may need to be broken off so that the component may be replaced or the whole pallet may need to be replaced if the components cannot be independently repaired. The exemplary pallets described herein are specifically reinforced based on the exact location of the structural member and are designed to be disassembled and reassembled easily and readily.

An exemplary pallet 100 including a plurality of structural members 110 and a plurality of support blocks 180 is shown in FIG. 1. The pallet 100 defines a first surface 103 (e.g., a top surface) and a second surface 104 (e.g., a bottom surface) opposite the first surface 103. The top surface 103 may be described as a deck, a cargo surface, a loading surface, etc. and may be configured to support any type of payload, freight, shipment, etc. that is positioned on the first surface 103. Also, the pallet may extend between a first end 101 and a second end 102. The pallet 100 may define a variety of different shapes suitable for carrying a payload. For example, the pallet 100 illustrated in FIG. 1 defines a parallelogram shape, specifically rectangular, when viewing orthogonal to the first surface 103. The overall size of the pallet 100 may be the same as most conventional pallets, e.g., 48 inches (1.2 m)×40 inches (1.0 m).

The plurality of structural members 110 may be positioned relative to one another such that at least two discrete openings 105 are defined. For example, the plurality of support blocks 180 are positioned between a first portion of the plurality of structural members 110 (e.g., a top portion) and a second portion of the plurality of structural members 110 (e.g., a bottom portion) such that the first portion of the plurality of structural members 110 are separated (e.g., not in contact with) the second portion of the structural members 110. The plurality of structural members 110 may be removably attached or coupled to the plurality of support blocks 180. In other words, each of the plurality of structural members 110 may be easily and readily attached and removed (e.g., without damaging or destroying (or while maintaining the integrity and form of) the structural members 110 or support blocks 180 that are not being replaced) from the plurality of support blocks 180 (e.g., to easily replace a damaged structural member 110). The at least two discrete openings 105 may be defined between the first portion of the plurality of structural members 110, the second portion of the plurality of structural members 110, and the plurality of support blocks 180.

As described further herein, the top outside members may be structural members 110 and the one or more members therebetween may be fill members 115 (e.g., members that are not considered structural as defined further herein). In other words, the first top member closest to each of the first and second ends 101, 102 of the pallet 100 may be considered structural members 110, but the fill members 115 in between may not be considered structural as further defined herein (e.g., may not include continuous fiber bundles contained therein). The fill members 115 may include one or more multiple members that are spaced across the first surface 103 of the pallet 100 or may include one member that spans between the structural member 110 closest the first end 101 of the pallet 100 and closest the second end 102 of the pallet 100.

The pallet 100 illustrated in FIG. 1 defines four side surfaces that are adjacent to and between the first and second surfaces 103, 104. For example, the pallet 100 may define a side surface 201 at the first end 101, a side surface 202 at the second end 102, and side surfaces 203, 204 between the first and second ends 101, 102 (and between the first and second surfaces 103, 104) on either side. Each of the four side surfaces may define various openings that may be used to allow a lifting device (e.g., tines of a mechanically assisted lifting device, such as a forklift or hand jack) to access the pallet 100 such that the pallet 100 may be lifted and moved. For example, the pallet 100 may define at least two discrete openings 105 on each of the four side surfaces 201, 202, 203, 204. Also, in one or more embodiments, the side surfaces 201, 202, 203, 204 may define a flush surface due to the relative arrangement of the structural members 110 and the support blocks 180. A pallet 100 defining openings on each of the four side surfaces may be described as providing four-way entry because the lifting device may access the pallet 100 from each of those four side surfaces.

The at least two discrete openings 105 may be arranged in a variety of different ways. For example, the at least two discrete openings 105 on each of the side surfaces of the pallet 100 may be the same dimensions and also symmetric across the center point of the side surface. In one or more embodiments, the at least two discrete openings 105 of each side surface of the pallet 100 may have identical dimensions such that each of the side surfaces provide an identical access to the lifting device so that, e.g., the pallet 100 may be accessed similarly from each side surface (e.g., the height from the ground to the opening 105 may be similar). In one or more embodiments, the structural member 110 that defines the bottom layer of the pallet 100 may include a bevel or chamfer that allows easier access for "walkies" (tines of a lifting device that have wheels that roll into the access openings) by providing a gradual ramp into the discrete openings 105 of the pallet 100.

The plurality of structural members 110 may include a variety of different types of structural members that may be positioned in different locations on the pallet 100 and each may be engineered (i.e., using selective reinforcements or material systems) for different purposes. For example, the plurality of structural members 110 may include two or more base members 120, two or more intermediate members 140, and two top outside members 160 as shown in the exploded perspective view of the pallet 100 in FIG. 2. In one or more embodiments, the plurality of structural members 110 may include additional types of structural members 110.

By separating the plurality of structural members 110 into multiple subsets, each type of structural member 110 may be selectively engineered for a different purpose to, e.g., increase overall performance of the pallet 100, reduce the cost of the pallet 100, reduce the weight of the pallet 100, improve the performance of the pallet 100 (in flexural or tensile strength, modulus, etc.), improve the predictive capability of design performance to actual performance of the pallet 100, improve the points and mode of failure of the pallet 100, etc. Other factors that are taken into account for each structural member 110 may include overall strength (e.g., long-term force applied) provided by each structural member 110 and impact resistance (e.g., energy dissipation from and rigidity to sudden impact) of each structural member 110. For example, many different characteristics of each structural member 110 may be modified to optimize these factors. Specifically, some examples of variables that may be modified within each structural member 110 may be the size, shapes, composition and formulation of base molding compounds or materials, the composition and formulation of selective reinforcements (including size shapes, diameter of fibers, type of fibers, number of fibers, fiber coatings, size of mesh openings or gaps, coatings, fiber manufacturing methods, fiber to resin percentages, etc.

For example, the material of the plurality of structural members 110 may affect the weight of each individual structural member 100. The weight of the overall pallet 100 may be important because the Occupational Safety and Health Administration (OSHA) requires a weight of less than 50 pounds (22.7 kg) to be suitable for one person manually lifting the pallet 100. In other words, a pallet 100 weighing over 50 pounds would require more than one person to move under OSHA standards unless using a mechanical assist device (e.g., a fork lift, a walkie, etc.). It is difficult to stay below this weight threshold with a composite pallet while maintaining the required physical performance, cost and durability. However, by using composite members with selective reinforcements (e.g., advanced fiber reinforcements), as described herein, this exemplary pallet 100 may be able to stay under 50 pounds and may meet a wide range of performance requirements (e.g., physical performance, cost, weight, durability, etc.).

The plurality of structural members may include (e.g., be made of or formed of) any suitable plastic or composite material. For example, the plurality of structural members 110 (e.g., base members 120, intermediate members 140, and/or top outside members 160) may include a thermoset, or thermoplastic (e.g., including a polyolefin such as polyethylene, or polypropylene). Using a composite material may prevent the structural members 110 from absorbing water or spilled product that comes into contact with the structural members 110, which may result in the members, e.g., being more sanitary, easier to clean, and less attractive to insects and fungi.

Figure 2:
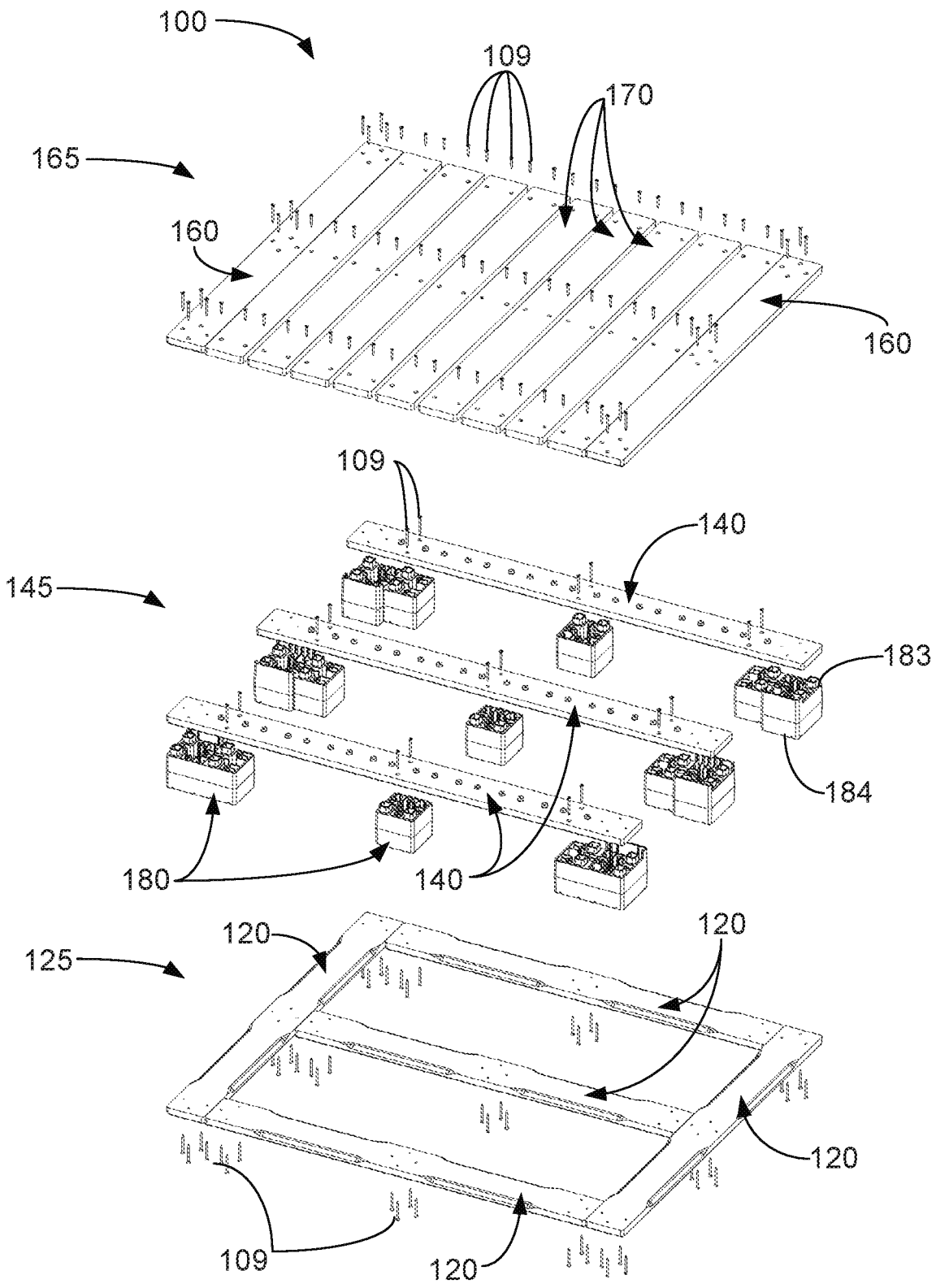
FIG. 2 is an exploded perspective view of the exemplary pallet of FIG. 1.

As shown in FIG. 2, each of the plurality of structural members 110 may be coupled to one another and the two or more support blocks 180 to form (e.g., assemble, construct, manufacture) the pallet 100. In one or more embodiments, the structural members 110 being removably coupled to the support blocks 180 may include any type of coupling or connecting that does not include adhesive or welding. Each of the plurality of structural members 110 may be grouped and arranged in layers for construction of the pallet 100. For example, the pallet 100 may include a base layer 125, an intermediate layer 145, and a top layer 165. Additionally, as shown, the pallet 100 may include two or more support blocks that separate the top and intermediate layers 165, 145 from the base layer 125 (e.g., to form openings 105 allowing the middle of the pallet 100 to be accessed such that the pallet 100 may be moved).

The base layer 125 may include two or more base members 120 that are positioned together to form the base layer 125. The base layer 125 may be described as a layer because the two or more base members 120 that make up the base layer 125 may create a generally even surface for each of the top and bottom surfaces. In other words, the top surfaces (e.g., a first surface 123 of each base member 120 as shown in FIG. 1) may be generally coplanar to form an even common surface layer. The base layer 125 may form a foundation on which the remainder of the pallet 100 may be located or positioned. For example, the two or more base members 120 of the base layer 125 may be removably coupled or connected or attached to the two or more support blocks 180 (e.g., using fasteners 109). The fasteners 109 may include any suitable component that may be used to connect elements. For example, the fasteners 109 may include screws or other easily removable fasteners. In one or more embodiments, the fasteners 109 may include any suitable fastener 109 that may be easily and readily removed and attached such that components may be repeatedly assembled, disassembled and reassembled easily and readily (e.g., without damaging or destroying components that are not being replaced in the pallet 100) without materially reducing the fasteners ability to provide a connection/coupling and without reducing the material performance of the components or pallet 100. Also, as shown in FIG. 2, the coupling of the base members 120 to the support blocks 180 may result in the coupling or connecting of two adjacent base members 120 (e.g., each adjacent base member 120 is removably coupled to a support block 180 such that each adjacent base member 120 is positioned relative to the other). In some embodiments, the base members 120 may be directly coupled to one another. As discussed herein, the two or more base members 120 may be arranged to form a rectangular base layer 125 (e.g., the typical shape formed by a pallet 100).

The two or more support blocks 180 may be coupled to the two or more base members 120 of the base layer 125 such that the support blocks 180 extend away from the base layer 125. Each support block 180 of the two or more support blocks 180 may define a first surface 183 and a second surface 184 opposite the first surface 183. The support blocks may be positioned such that the second surface 184 of the support block 180 is adjacent the base layer 125 when the support blocks 180 are removably coupled to the base members 120 and the first surface 183 of the support block 180 is adjacent the intermediate layer 145 when the support blocks are removably coupled to the intermediate members 140.

The two or more support blocks 180 may include various numbers of support blocks 180 to help support and separate the base layer 125 and the intermediate layer 145. For example, as shown in FIG. 2, a support block 180 is positioned in each corner of the base layer 125 as well as in between the corners and in the middle of the base layer 125. Additionally, the support blocks 180 are positioned at each end of the intermediate members 140 and in between each end of the intermediate members 140. Furthermore, the support blocks 180 may include a variety of different types of support blocks 180, which will be discussed further herein, including the specific arrangement of the different types of support blocks 180.

The intermediate layer 145 may include two or more intermediate members 140 that are positioned together to form the intermediate layer 145. The intermediate members 140 may be positioned on the support blocks 180 opposite the base members 120. In other words, the intermediate members 140 may be positioned on the first surface 183 of the support blocks 180 (with the base members 120 positioned on or removably coupled to the second surface 184 of the support blocks 180). Specifically, the intermediate members 140 may be removably coupled to first surface 183 of the support blocks 180 (e.g., using fasteners 109). As a result, the two or more intermediate members 140 may be separated from and positioned relative to the two or more base members 120 by the two or more support blocks 180 because each may be removably coupled to opposing sides of the support blocks 180 (e.g., the base members 120 removably coupled to the second surface 184 of the support blocks 180 and the intermediate members 140 removably coupled to the first surface 183 of the support blocks 180).

The intermediate layer 145 may be described as a layer because the two or more intermediate members 140 that make up the intermediate layer 145 may create a generally even surface for each of the top and bottom surfaces of the intermediate members 140. In other words, the top surfaces (e.g., a first surface 143 of each intermediate member 140) may be generally coplanar to form an even common surface layer. In this way, the intermediate members 140 may be positioned on an even surface (e.g., the support blocks 180) and result in an even surface (e.g., for which the top layer 165 may be positioned).

The top layer 165 may include two top outside members 160 and one or more top middle members 170 positioned between the two top outside members 160. The two top outside members 160 may be described as structural members 110 and the one or more top middle members 170 may be described as "non-structural" or fill members. The term "non-structural" is not intended to denote that the one or more top middle members 170 do not provide structure, but rather, may not include certain selective reinforcements (e.g., continuous fiber bundles disposed therein) that may be found in structural members 110. The top outside members 160 and the one or more top middle member 170 may be positioned on the intermediate members 140. The top layer 165 may be described as a layer because the two top outside members 160 and the one or more top middle members 170 that make up the top layer 165 may create a generally even surface for each of the top and bottom surfaces of the two top outside members 160 and the one or more top middle member 170. In other words, the top surfaces (e.g., a first surface 163 of the two top outside members 160 and a first surface 173 of the one or more top middle members 170) may be generally coplanar to form an even common surface layer. This even common surface layer (of the top layer 165) may be one that any sort of cargo or payload may be placed.

The top outside members 160 and the one or more top middle members 170 may be removably coupled to the intermediate members 140. Further, the top outside members 160 and the one or more top middle members 170 may be removably coupled to the support blocks 180. For example, in one more embodiments, the top outside members 160 and the one or more top middle members 170 may be removably coupled to the support blocks 180 through the intermediate members 140.

Figure 3A:
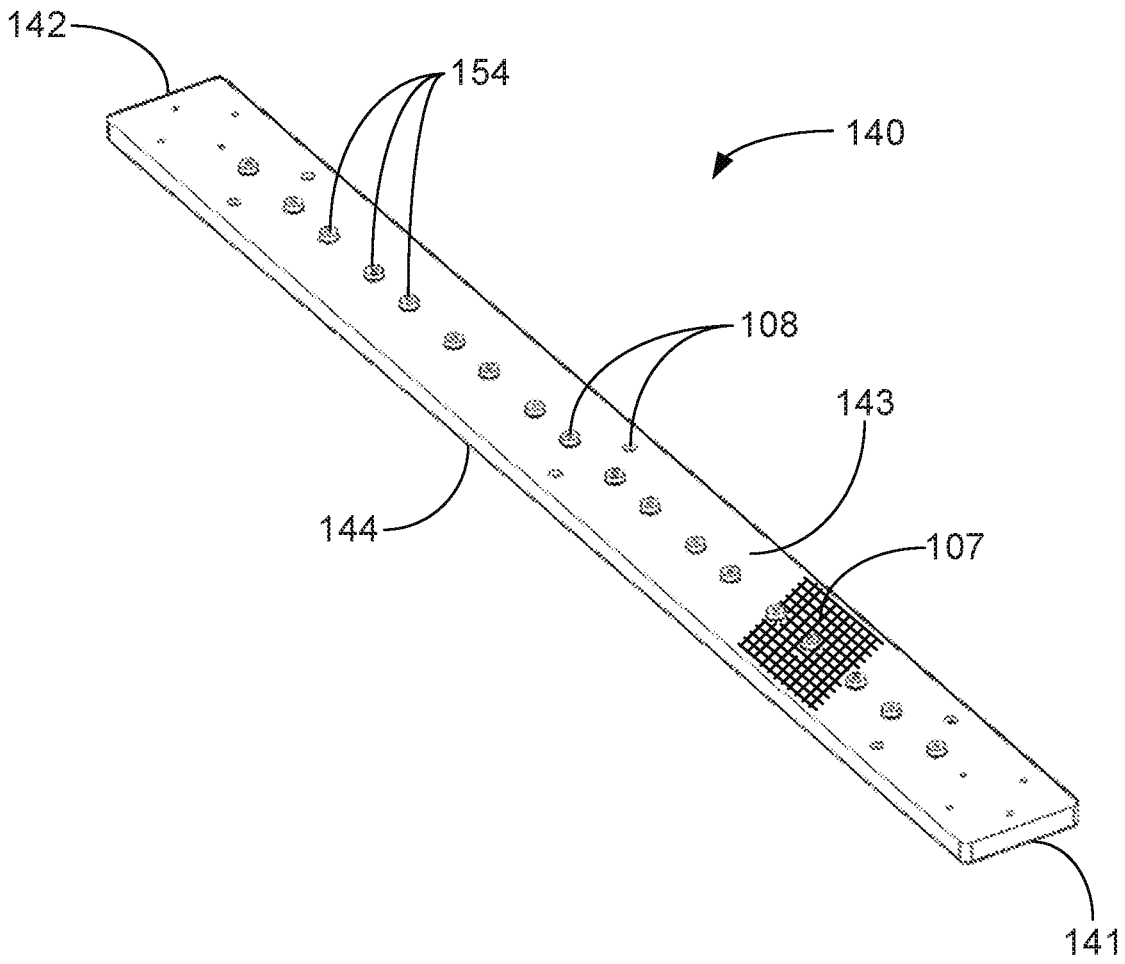
FIG. 3A is a top perspective view of an exemplary intermediate member of the exemplary pallet of FIG. 1.
Figure 3B:
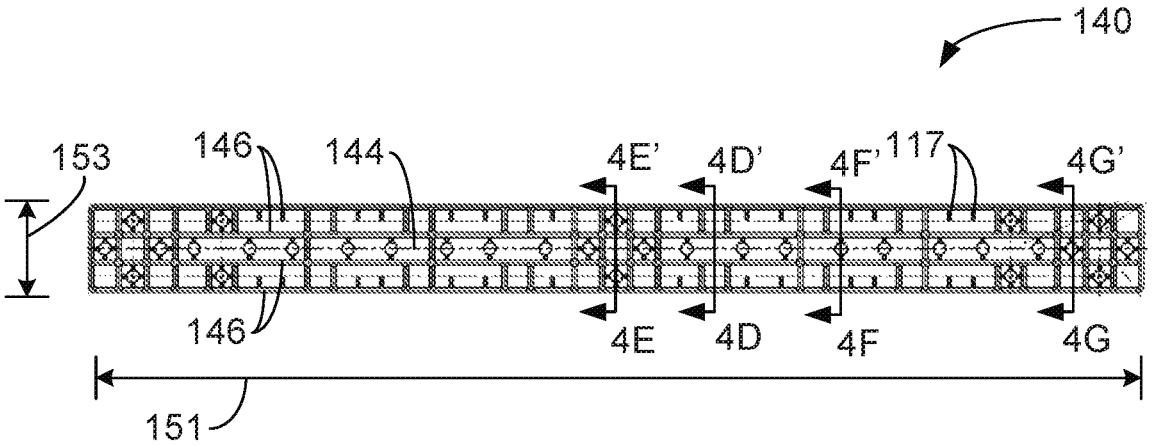
FIG. 3B is a bottom plan view of the exemplary intermediate member of FIG. 3A.
Figure 3C:
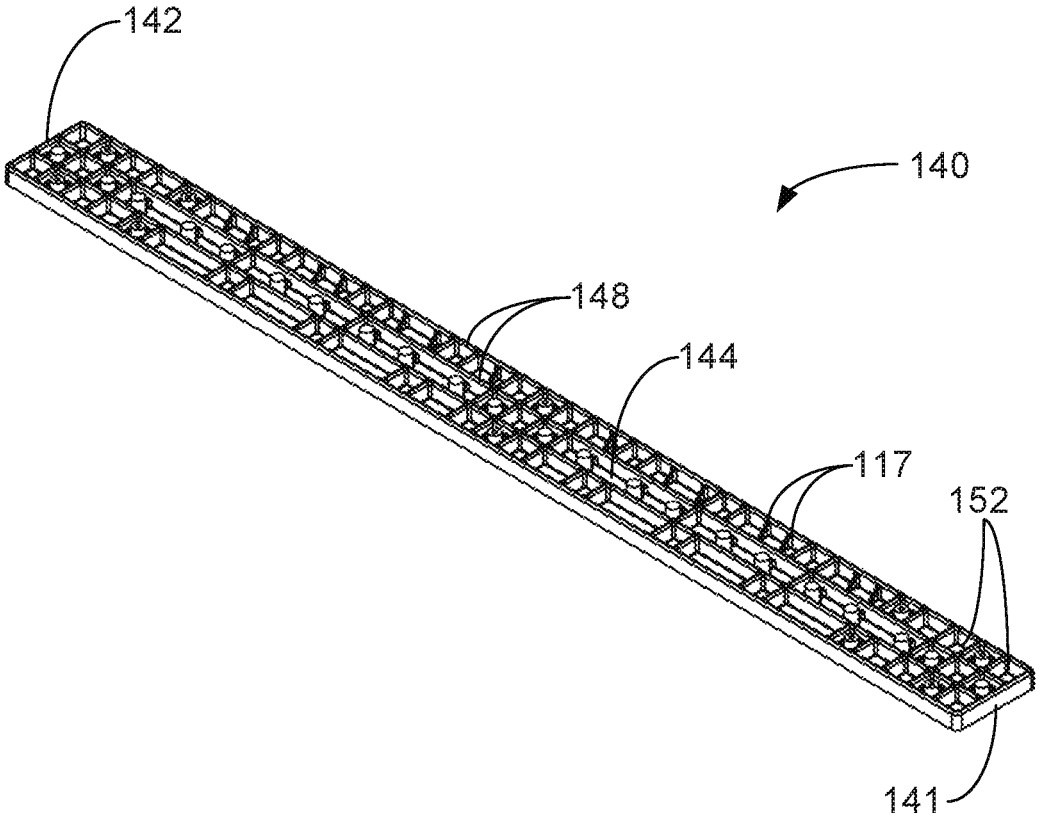
FIG. 3C is a bottom perspective view of the exemplary intermediate member of FIG. 3A.

One exemplary intermediate member 140 of the two or more intermediate members 140 is shown in FIGS. 3A-3C. The intermediate member 140 may define a first surface 143 and a second surface 144 opposite the first surface 143 (e.g., the second surface 144 may be parallel to the first surface 143). Also, the intermediate member 140 may extend between a first end 141 and a second end 142. The intermediate member 140 may define a variety of different shapes and sizes. For example, the intermediate member 140 may define a rectangular prism shape or a "board-like" shape. Specifically, the first and second surfaces 143, 144 of the intermediate member 140 may define a major surface such that the surface areas of each of the first and second surfaces 143, 144 of the intermediate member 140 are significantly larger than the other surfaces of the intermediate member 140. For example, the length 151 of the intermediate member 140 measured between the first end 141 and the second end 142 may be 48 inches (e.g., about 1.2 m). The width 153 of the intermediate member 140 (e.g., along the first or second surface 143, 144 and perpendicular to the length 151) may be 4 inches (e.g., about 10 cm). The thickness of the intermediate member 140 (e.g., perpendicular to both the length 151 and width 153, measured from the first surface 143 to a rib end portion 148) may be 0.75 inches (e.g., about 1.9 cm). Additionally, each of the intermediate members 140 may weigh about greater than or equal to 1 pound, greater than or equal to 1.5 pounds, greater than or equal to 2 pounds, greater than or equal to 2.5 pounds, etc. and/or less than or equal to 5 pounds, less than or equal to 4 pounds, less than or equal to 3.5 pounds, less than or equal to 3 pounds, etc. More specifically, each of the intermediate members 140 may weigh about 2.4 pounds to 3.2 pounds (e.g., for a base molding compound of about 40% to 50% long fiber thermoplastic).

As discussed herein, the intermediate members 140 may include selective reinforcements (e.g., advanced fiber reinforcements) to improve the strength and impact resistance of the member. The selective reinforcements (e.g., advanced fiber reinforcements) are described herein with respect to the intermediate members 140 shown in FIGS. 3A-3G, however, the selective reinforcements may apply to any of the structural members 110 (e.g., the base members 120, the intermediate members 140, and the top outside members 160). Additionally, in some embodiments, the selective reinforcements may apply to the one or more top middle members 170 and the support blocks 180 as well. The selective reinforcements may include ribs extending from a major surface of the structural member 110, fiber dispersed within the structural member 110, a continuous fiber bundle located in the ribs of the structural member 110, and/or a mesh disposed within the structural member 110.

For example, the structural members 110 (e.g., base member 120, intermediate member 140, top outside member 160) may comprise (e.g., be made of or formed of) a base molding compound (e.g., a composite material such as polypropylene) with fiber dispersed in the compound (e.g., using injection molding, compression molding, etc.). For example, base molding compound may include fiber (e.g., glass, carbon, etc.) reinforced materials (e.g., long or short fiber) dispersed in the compound.

The structural members 110 may be formed of any suitable polymeric material. In many embodiments the polymeric material is a thermoplastic material. Useful polymeric material includes polypropylene, polyethylene, nylon, acrylonitrile butadiene styrene, styrene acrylonitrile, acrylic or styrene, for example. Further useful polymers include PBT polyester, PET polyester, polyoxymethylene, polycarbonite or polyphenylene sulfide for example. Higher temperature polymeric material includes polysulfone, polyethersulfone, polyetheretherketone, or liquid crystal polymer, for example.

Specifically, the structural members 110 may include about greater than or equal to 20%, greater than or equal to 30%, greater than or equal to 35%, greater than or equal to 40%, greater than or equal to 45%, etc. and/or less than or equal to 60%, less than or equal to 55%, less than or equal to 50%, less than or equal to 42%, etc. long or short fiber (by weight). More specifically, the structural members 110 may include about 40% to 50% of the base wt long fiber thermoplastic. The types of long or short fiber included in the base molding compound may include glass or carbon and may be sized at an average length of about less than 15 mm and an average diameter of about less than 50 micrometers. For example, the fiber dispersion may be as described in U.S. patent application Ser. No. 14/621,188, filed on Feb. 12, 2015, and entitled, "COMPOSITE STRUCTURAL ARTICLE," which is hereby incorporated herein by reference in its entirety to the extent that it does not conflict with the present disclosure. In one or more embodiments, the material of the structural member 110 may be described as a long fiber thermoplastic material.

In many embodiments a plurality of fibers form a fiber dispersion within the structural members 110. The fibers forming this fiber dispersion have an average length of less than 15 mm and an average diameter of less than 50 micrometers. The polymeric material forming the solid or polymeric body may include a plurality of random fibers forming a fiber dispersion in the polymeric material. This fiber dispersion has an average fiber length of less than 15 mm or less than 12 mm or less than 5 mm or less than 1 mm. The fiber dispersion has an average fiber length in a range from 1 to 15 mm or in a range from 5 to 12 mm and can be termed "long fiber thermoplastic". In other embodiments, the fiber dispersion has an average fiber length in a range from 0.1 to 1 mm or in a range from 0.25 to 0.75 mm and can be termed "short fiber thermoplastic".

The fibers forming the fiber dispersion can be formed of materials that are the same or different than the material forming the continuous fiber bundle 149 such as glass, carbon, basalt, graphite, DuPont Kevlar brand aramid fibers, ceramics, natural fibers, polymeric fibers, and various metals, for example. Preferably fibers forming the fiber dispersion can be composed of glass, carbon, graphite or Kevlar (i.e., poly-paraphenylene terephthalamide) fibers. In some embodiments the fibers forming the fiber dispersion are a mixture of glass and carbon fibers or glass and Kevlar fibers or glass and graphite fibers. In some embodiments the fibers forming the fiber dispersion is glass and the fibers forming the continuous fiber bundle 149 are carbon, Kevlar or graphite or a mixture of glass and carbon, Kevlar or graphite.

Polymer material "wets out" the co-extending continuous fibers forming the continuous fiber bundle 149. Thus resin or polymeric material is dispersed about all of the co-extending continuous fibers forming the continuous fiber bundle 149. The forming the continuous fiber bundle 149 can include at least 1000, or at least 5000, or at least 10000 or at least 15,000 co-extending continuous glass fibers.

In many embodiments, the continuous fiber bundle 149 contains co-extending continuous fibers that are not uniformly distributed throughout a cross-section of the continuous fiber bundle 149 and may concentrate towards the longitudinal axis of the continuous fiber bundle 149. This may occur due as the fibers are twisted. In many of these embodiments a skin layer of polymer (that forms the polymeric body) may form on the outer surface of the continuous fiber bundle 149 where there is no co-extending continuous fibers. This skin layer may form 10% or less or from 1 to 10% of the diameter of the continuous fiber bundle 149. In some embodiments the co-extending continuous fibers are uniformly distributed throughout a cross-section of the continuous fiber bundle 149.

Figure 3D:
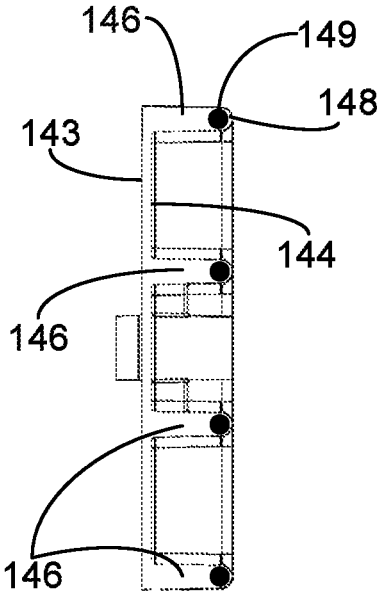
FIG. 3D is a cross-sectional view of the exemplary intermediate member of FIG. 3B taken across line 3D'-3D.

Furthermore, the intermediate members 140 (or base members 120/top outside members 160) may include two or more ribs 146 that extend away from the second surface 144 of the intermediate member 140 to a rib end portion 148 (e.g., as shown in FIG. 3D) between the first and second ends 141, 142 of the intermediate member 140. The intermediate member 140 may include any number of ribs positioned in this fashion. For example, as shown in FIGS. 3B and 3C, the intermediate member 140 includes four ribs 146 extending (e.g., parallel and equidistant from one another) from the second surface 144 (e.g., extending from a major surface of the intermediate member 140) of the intermediate member 140. In other embodiments, the structural member 110 may include two, three, four, five, six, etc. ribs. A cross-section of the four ribs 146 is shown in the cross-sectional view illustrated in FIG. 3D (which is a cross-sectional view of the intermediate member 140 of FIG. 3B taken across line 3D-3D').

The two or more ribs 146 may define various different sizes. For example, a wider rib 146 (measured perpendicular to the direction the rib extends) may provide increased structural rigidity by, e.g., increasing the amount of material contained within the rib or allowing for a larger fiber bundle (further described herein) to be disposed therein. Specifically, the width of the rib 146 may be about greater than or equal to 0.1 inches, greater than or equal to 0.125 inches, greater than or equal to 0.147 inches, etc. and/or less than or equal to 0.25 inches, less than or equal to 0.212 inches, less than or equal to 0.193 inches, etc. As shown in FIG. 3D, the width of the rib 146 may be substantially smaller than the width of the member from which the rib 146 extends. For example, each rib 146 may define a width that is only 5% to 15% of the width 153 (e.g., as shown in FIG. 3B) of the intermediate member 140. The two or more ribs 146 may all define the same width or the two or more ribs 146 may define varying widths. For example, ribs 146 on the outside of the intermediate member 140 may define a width that is greater than ribs 146 located between the outside ribs. This configuration (wider outside ribs than inside ribs) may provide for increased support and impact resistance because the outside ribs may be more exposed to external factors (e.g., impact from lifting devices).

The two or more ribs 146 may also define a length extending away from and perpendicular to the second surface 144 of the intermediate member 140. As described herein, the thickness of the structural member 110 (e.g., the base member 120, the intermediate member 140, the top outside member 160) from a first surface (e.g., first surface 143) to a rib end portion (e.g., the rib end portion 148) may be about 0.75 inches, which, for example, is a combination of distances between the first and second surfaces 143, 144 and between the second surface 144 and rib end portion 148. In other words, an increase or decrease in the distance between first and second surfaces 143, 144 may result in a corresponding decrease or increase, respectively, in the distance between the second surface 144 and the rib end portion 148. The distance between the first and second surfaces 143, 144 of the intermediate member 140 (or, e.g., any other structural member 110) may be about 0.075 inches to 0.2 inches. Therefore, the distance between the second surface 144 of the intermediate member 140 (or, e.g., any other structural member 110) may be about 0.675 inches to 0.55 inches. In other words, the cumulative thickness of the intermediate member 140 (e.g., from the first surface 142 to the rib end portion 148) may add up to 0.75 inches.

The intermediate member 140 may also include one or more angled portions 117 as shown in FIGS. 3B and 3C. The one or more angled portions 117 may be positioned between and coupled to each of the second surface 144 and the outside rib 146. The one or more angled portions 117 may provide additional structural rigidity and strength to the intermediate member 140. For example, the one or more angled portions 117 may prevent the outside rib 146 from deflecting inwards or outwards.

Figure 3E:
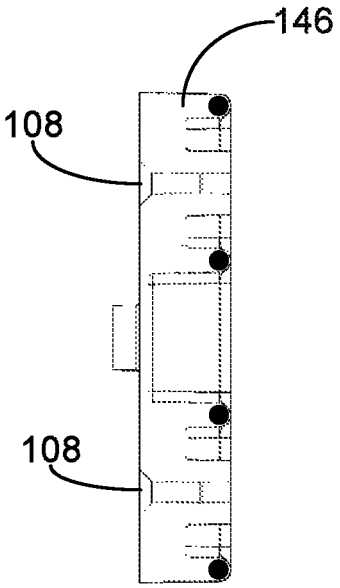
FIG. 3E is another cross-sectional view of the exemplary intermediate member of FIG. 3B taken across line 3E'-3E.
Figure 3F:
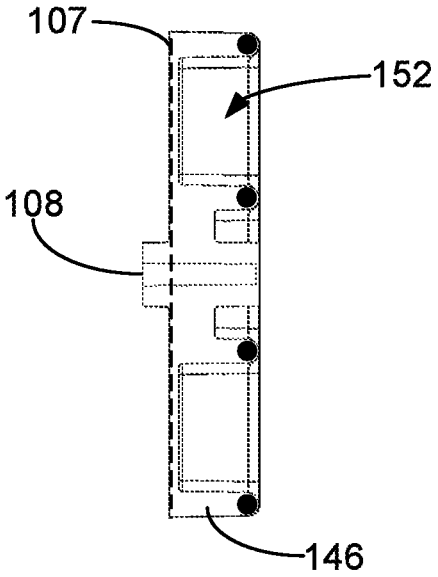
FIG. 3F is yet another cross-sectional view of the exemplary intermediate member of FIG. 3B taken across line 3F'-3F.
Figure 3G:
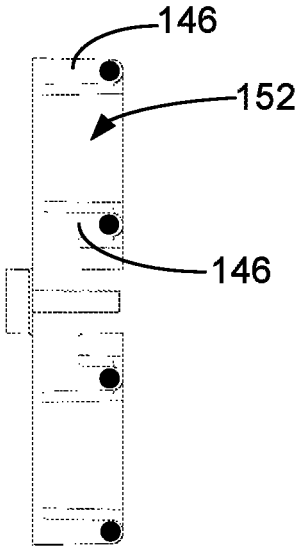
FIG. 3G is yet another cross-sectional view of the exemplary intermediate member of FIG. 3B taken across line 3G'-3G.

Another type of selective reinforcement that may be included in the structural members 110 (e.g., the base member 120, intermediate member 140, top outside member 160) may be a continuous fiber bundle 149 as illustrated in the cross-sectional view of FIG. 3D (as well as FIGS. 3E-3G). In some embodiments, the continuous fiber bundle 149 may be described as a tension member that is, e.g., a pultruded rod with continuous co-axial glass fibers in a thermoplastic resin matrix. The continuous fiber bundle may be a bundle of fibers that may provide strength in tension to increase the overall strength of the intermediate member 140 by preventing the intermediate member 140 from bowing or cracking or breaking when a force is applied to the intermediate member 140 (e.g., the continuous fiber bundle 149 provides increased strength for a force applied on a surface opposite where the continuous fiber bundle 149 is embedded, thus, placing the continuous fiber bundle 149 in tension). The continuous fiber bundle 149 may include a range of thickness/filament counts to vary the overall strength of the continuous fiber bundle 149. For example, the continuous fiber bundles 149 may define a thickness (e.g., a diameter) of about greater than or equal to 0.05 inches, greater than or equal to 0.1 inches, greater than or equal to 0.125 inches, etc. and/or less than or equal to 0.25 inches, less than or equal to 0.2 inches, less than or equal to 0.15 inches, etc. Also, for example, the continuous fiber bundles 149 may include at least between 1,000 and 20,000 continuous fibers dispersed in a thermoplastic material. In one or more embodiments, the continuous fiber bundles 149 may be twisted to further increase the tensile strength. For example, the continuous fiber bundles 149 may be grouped in portions of 4,000 continuous fibers that are twisted and combined with additional groups of continuous fibers that may be twisted. Specifically, the continuous fiber bundles 149 may be as described in U.S. patent application Ser. No. 14/621,188, filed on Feb. 12, 2015, and entitled, "COMPOSITE STRUCTURAL ARTICLE," and International Patent Application No. PCT/US16/17519, filed on Feb. 11, 2016, and entitled, "PRE-STRESSED FIBER REINFORCING MEMBER," and International Application No. PCT/US2015/044789, filed on Aug. 12, 2015, and entitled, "REINFORCING ARTICLE," which are both hereby incorporated herein by reference in their entirety to the extent that it does not conflict with the present disclosure.

In many embodiments the polymer utilized to form the continuous fiber bundle 149 is compatible with, or is the same type or kind of, polymer material forming the structural members 110. In some embodiments the polymer utilized to form the continuous fiber bundle 149 is a different type or kind of polymer material forming the structural members 110. The polymer material forming the continuous fiber bundle 149 may be free of a long or short fiber dispersion. In many embodiments the continuous fiber bundle 149 has an outer "skin" layer that does not include, or is free of the fiber dispersion that is present in the structural members 110.

The continuous fiber bundle 149 may be positioned at any location within any or all of the structural members 110 (e.g., base member 120, intermediate member 140, top outside member 160). For example, as shown in the cross-sectional view illustrated in FIGS. 3D-3G, the continuous fiber bundle 149 may be positioned in each of the two or more ribs 146 proximate the rib end portion 148. For example, the continuous fiber bundle 149 may extend along the corresponding rib 146 (e.g., at the rib end portion 148) between the first and second ends 141, 142 of the intermediate member 140. As described herein, the width of each rib 146 may vary, which may accommodate a wider continuous fiber bundle 149 to, e.g., increase the strength of the intermediate member 140.

Yet another type of selective reinforcement that may be included in the structural members 110 (e.g., base members 120, intermediate members 140, top outside members 160) and the top middle members 170 may be an open mesh 107, e.g., as shown in FIG. 3A. It is noted that the mesh 107 may be located on any of the structural members 110 and/or the top middle members 170 even though the mesh is only illustrated relative to the intermediate member 140 illustrated in FIG. 3A. The mesh 107 may be either a structural mesh or an impact mesh.

The structural mesh 107 can have any useful void size separating the intersecting continuous fiber members. In preferred embodiments the openings are in a range from about ⅛ inch to about ½ inch square or in mesh size of about 8 to about 2 mesh or from about 4 to about 5 mesh (openings per inch). In many embodiments the openings have an average lateral distance of at least 1 mm or at least 2 mm or at least 5 mm. The opening allows molten polymer to flow through the structural mesh 107 during a molding process.

The structural mesh may help to improve the structural strength of the structural member 110. For example, placing the mesh 107 close to the first surface 143 of the intermediate member 140 may improve the strength of the intermediate member 140 when force is applied on the second surface 144 (or two or more ribs 146) towards the first surface 143 of the intermediate member 140, e.g., when the tines of a lifting device is lifting the pallet 100 or if the pallet 100 is rail racked (placing concentrated force at specific points proximate the effectively bottom surface or the end of the ribs at the rib end portion 148). For example, the force may be applied to the rib end portions 148, which may then be transmitted up through the ribs 146 to distribute pressure to the second surface 144 (e.g., rail racked against the bottom layer of the rib plane in a concentrated way because the force may be applied only on a narrow portion of the intermediate member 140, e.g., the rib 146). The structural mesh may include flexible meshes of continuous glass fibers with a resin coating and may be a similar material to the remainder of the structural member 110 for which it is embedded.

The impact mesh may help to improve resilience to harsh impact from the external factors such as tines of a lifting device or dropped cargo. For example, the impact mesh may be included in the top layer 165 (e.g., the top outside members 160 and the one or more top middle member 170) to withstand impact forces from cargo or payloads that may be dropped onto the pallet 100. Similar to the structural mesh, the impact mesh may be embedded or positioned in the intermediate member 140 (or any other structural member 110/top middle member 170) proximate the first surface 143 of the intermediate member 140. The impact mesh may include woven mesh with a modified resin formulation to impart flexibility for impact absorption and may be a different type of material as compared to the remainder of the member (e.g., structural member 110 or top middle member 170) for which it is embedded. It is also noted that the mesh 107 (e.g., structural mesh or impact mesh) illustrated in FIG. 3A is visible on the first surface 143 of the intermediate surface 140 for illustrative purposes and the mesh 107 may be embedded in the intermediate member 140 such that the mesh 107 may be located just under the first surface 143 of the intermediate member 140.

The structural members 110 may also define apertures 108 or bosses/holes/openings (e.g., molded-in bosses) through which the fasteners 109 may extend to attach different components (e.g., base/intermediate/top outside members 120, 140, 160 and support blocks 180) of the pallet 100. For example, the apertures 108 may extend through the thickness of the intermediate member 140 as shown in the cross-sectional view illustrated in FIG. 3E. Specifically, the aperture 108 extends from the first surface 143 of the intermediate member 140 through the entirety of the intermediate member 140. The apertures 108 illustrated in FIG. 3E may specifically be used for the insertion of a fastener 109 through the intermediate member 140 and into a support block 180 (which may be removably attached proximate the two or more ribs 146 of the intermediate member 140). The apertures 108 may be dimensioned such that the diameter of each aperture 108 is slightly smaller than the diameter of the fasteners 109 (e.g., screws) so that the fasteners 109 contact the inner surfaces of the apertures 108, which may provide a stronger bond between the fasteners 109 and the pallet 100 components (e.g., structural members 110, base members 120, intermediate members 140, top outside members 160, top middle members 170, support blocks 180, etc.). However, the repeated insertion and removal of the fastener 109 from the aperture 108 may not degrade the aperture 108 for future fastener 109 attaching.

Figure 6A:
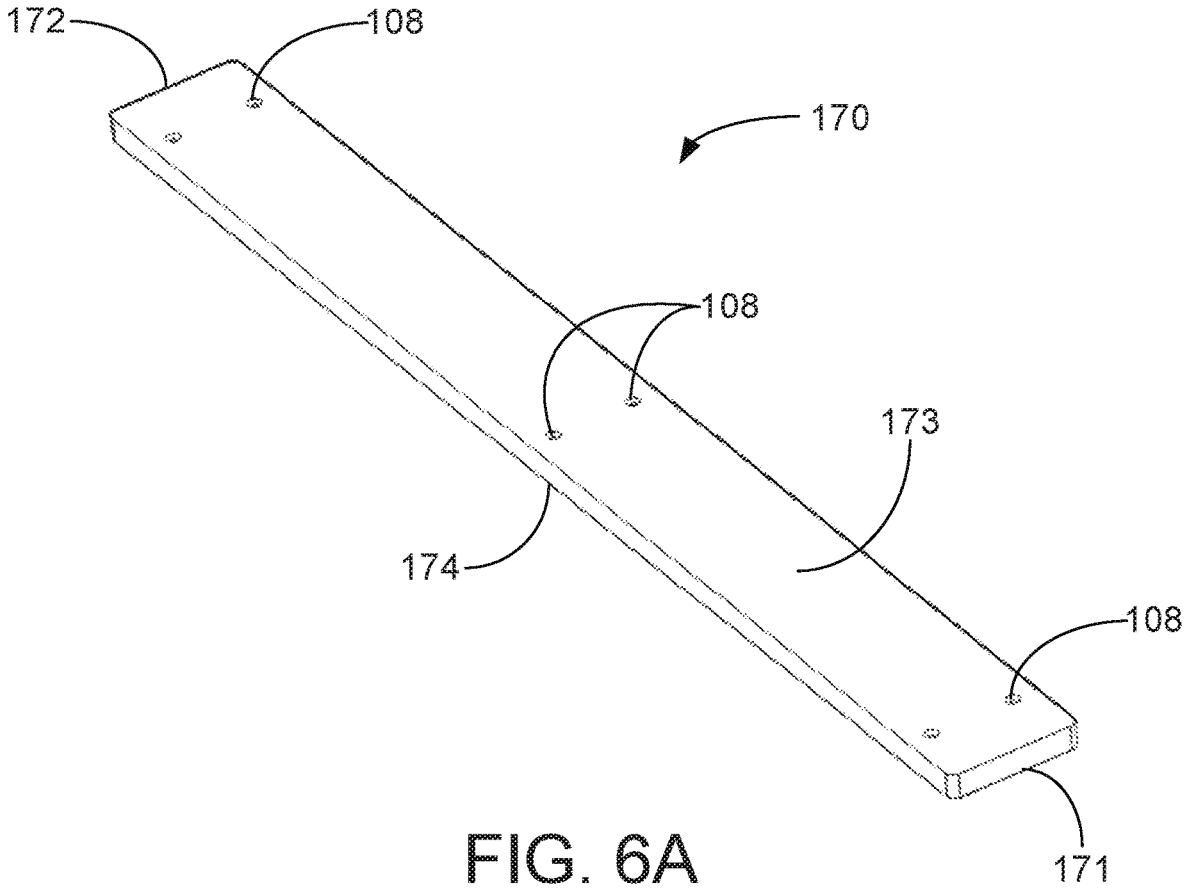
FIG. 6A is a top perspective view of an exemplary top middle member of the exemplary pallet of FIG. 1.
Figure 6B:
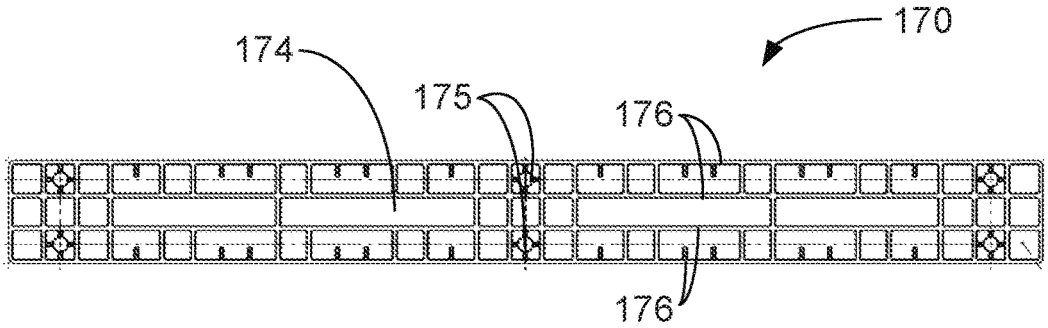
FIG. 6B is a bottom plan view of the exemplary top middle member of FIG. 6A.
Figure 6C:
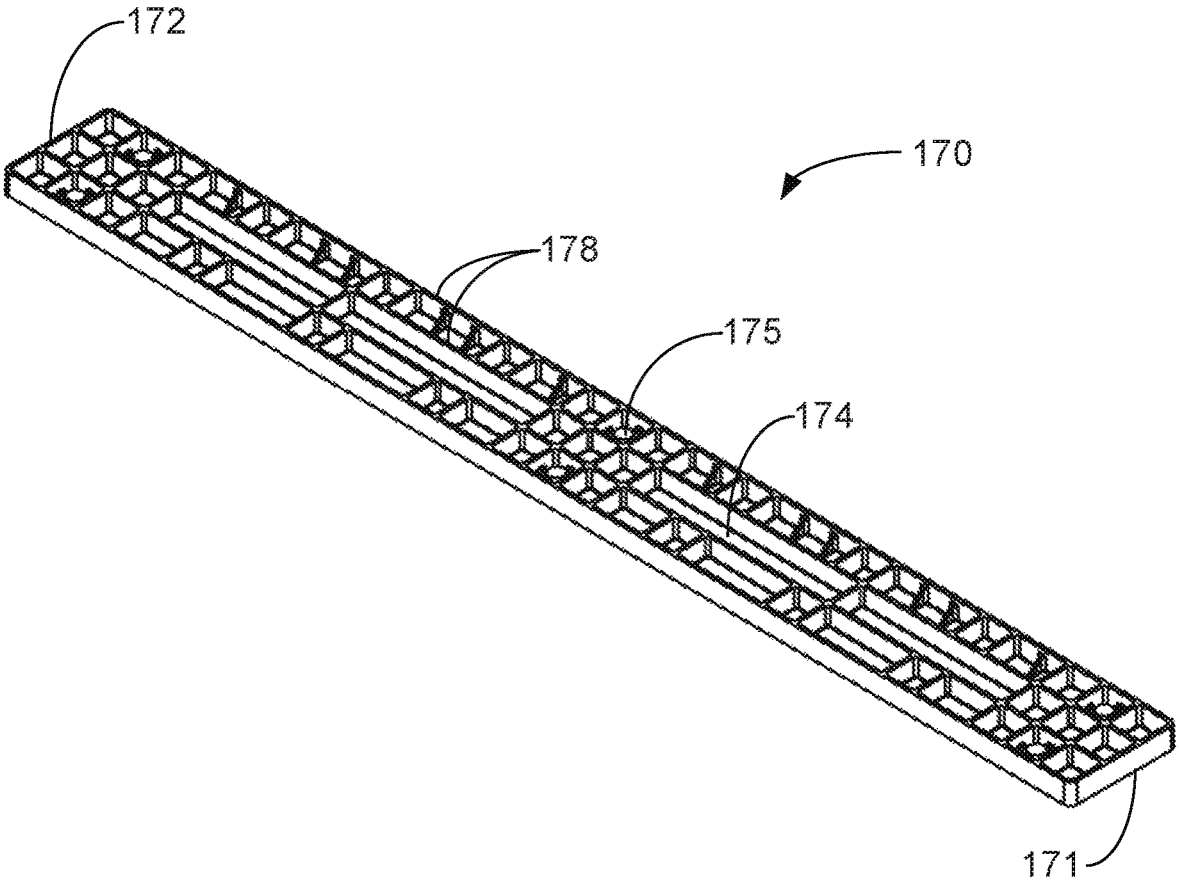
FIG. 6C is a bottom perspective view of the exemplary top middle member of FIG. 6A.

In one or more embodiments, the intermediate members 140 may also include protrusions 154 located on the first surface 143 of the intermediate member 140 as shown in FIG. 3A. In other words, protrusions 154 may extend from the first surface 143 of the intermediate member 140. These protrusions 154 may be used to help locate the top layer 125 such that the top outside members 160 and the top middle members 170 are properly positioned on the intermediate members 140 and relative to each other. For example, the one or more top middle member 170 may define recesses 175 (e.g., as described further herein and shown in FIGS. 6B and 6C) that may receive the protrusions 154 of the intermediate members 140 when the intermediate members 140 and the one or more top middle member 170 are removably coupled. The receiving of the protrusions 154 of the intermediate members 140 by the recesses 175 of the one or more top middle members 170 may provide advantages such as, locating and positioning the one or more top middle member 170, improving ease of assembly, increasing the impact strength and energy dissipation (e.g., by increasing the surface area for which the members may apply forces on one another in a shear direction), ensuring squareness of the members relative to one another, etc.

Additionally, the intermediate member 140 may define an aperture 108 that extends through the protrusion 154 as shown in FIG. 3F. The aperture 108 illustrated in FIG. 3F may be used for insertion of a fastener 109 through the one or more top middle member 170 and into the intermediate member 140 (e.g., through the aperture 108 shown in FIG. 3F) to removably couple the intermediate members 140 to the one or more top middle member 170. The aperture 108 may extend from the first surface 143 or protrusion 154 of the intermediate member 140 through the entirety of the intermediate member 140. In other embodiments, the aperture 108 may extend from the first surface 143 or protrusion 154 of the intermediate member 140, but not all the way through the intermediate member 140. For example, the aperture 108 may be effectively used as a guide for the fastener 109, but may not need to extend through the entirety of the intermediate member 140 (e.g., because the intermediate member 140 may be only coupled to the top layer 125 above it). Further, the aperture 108 may not extend through the entirety of the intermediate member 140 because there may be a possibility of interference during assembly with a top surface of a component positioned below the second surface 144 of the intermediate member 140. However, in some embodiments, the aperture 108 may extend through the entirety of the intermediate member 140 to couple the intermediate member 140 something both above (e.g., the top layer 125) and below (e.g., the support blocks 180) the intermediate member 140.

Further, the intermediate member 140 may define recesses 152 proximate the second surface 144 of the intermediate member 140 as shown in the cross-sectional view illustrated in FIG. 3G. The recesses 152 of the intermediate member 140 may be configured to receive components of the support blocks 180 (e.g., protrusions 185 of the support blocks 180) to position the intermediate members 140 relative to the support blocks 180. The interaction of the recesses 152 of the intermediate member 140 and the protrusions 185 of the support blocks 180 may also provide, e.g., easier locating of the intermediate members 140 relative to the support blocks 180 (including lining up the apertures 108 of each such that a fastener 109 may be inserted for removably coupling), easier assembly, increased impact strength and energy dissipation (through interlocking of protrusions 185 and recesses 152), squareness of the intermediate members 140 relative to the support blocks 180. With respect to the increased impact strength and energy dissipation, the insertion of the protrusions 185 of the support blocks 180 into the recesses 152 of the intermediate members 140 may provide surfaces (of the protrusion 185 and recesses 152) that contact perpendicular to the second surface 144 of the intermediate member 140, and thus, may help dissipate shear forces due to a greater surface area interface. Without the protrusions 185 and recesses 152, the fasteners 109 connecting the support block 180 to the intermediate member 140 may be exposed to a shear force that could result in damage to, e.g., the fasteners 109. In some embodiments, the protrusions 185 of the support blocks 180 may provide an interference fit with the recesses 152 of the intermediate members 140 to assist in coupling them together.

The recesses 152 of the intermediate members 140 may be any shape or size. For example, the recesses 152 of the intermediate member 140 may be sized such that the recesses 152 receive the protrusions 185 of the support block 180 without slack or gaps between them. Also, the recesses 152 of the intermediate members 140 may be defined at least partially by the two or more ribs 146 of the intermediate members 140 as shown in FIGS. 3B, 3C, and 3G. Further, the recesses 152 of the intermediate members 140 may be defined by cross ribs that extends perpendicular to the two or more ribs 146 (e.g., across the width 153 of the intermediate member 140). It is noted that the cross ribs of the intermediate member may or may not include continuous fiber bundles 149 similar to those located within the two or more ribs 146 of the intermediate member 140.

Figure 4A:
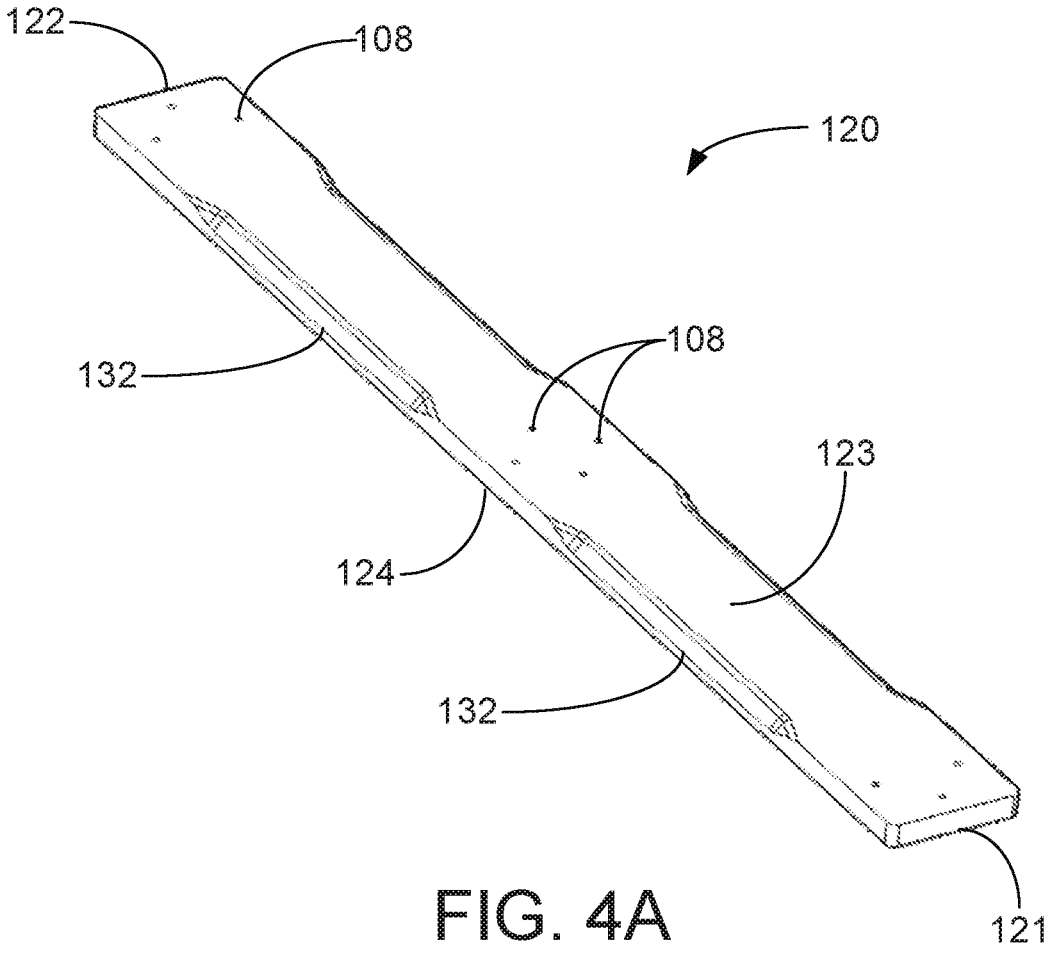
FIG. 4A is a top perspective view of an exemplary base member of the exemplary pallet of FIG. 1.
Figure 4B:
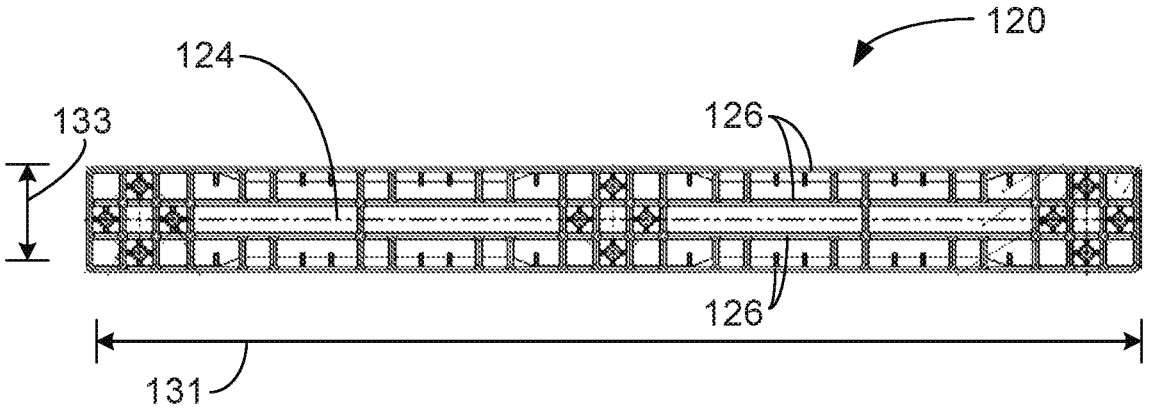
FIG. 4B is a bottom plan view of the exemplary base member of FIG. 4A.
Figure 4C:
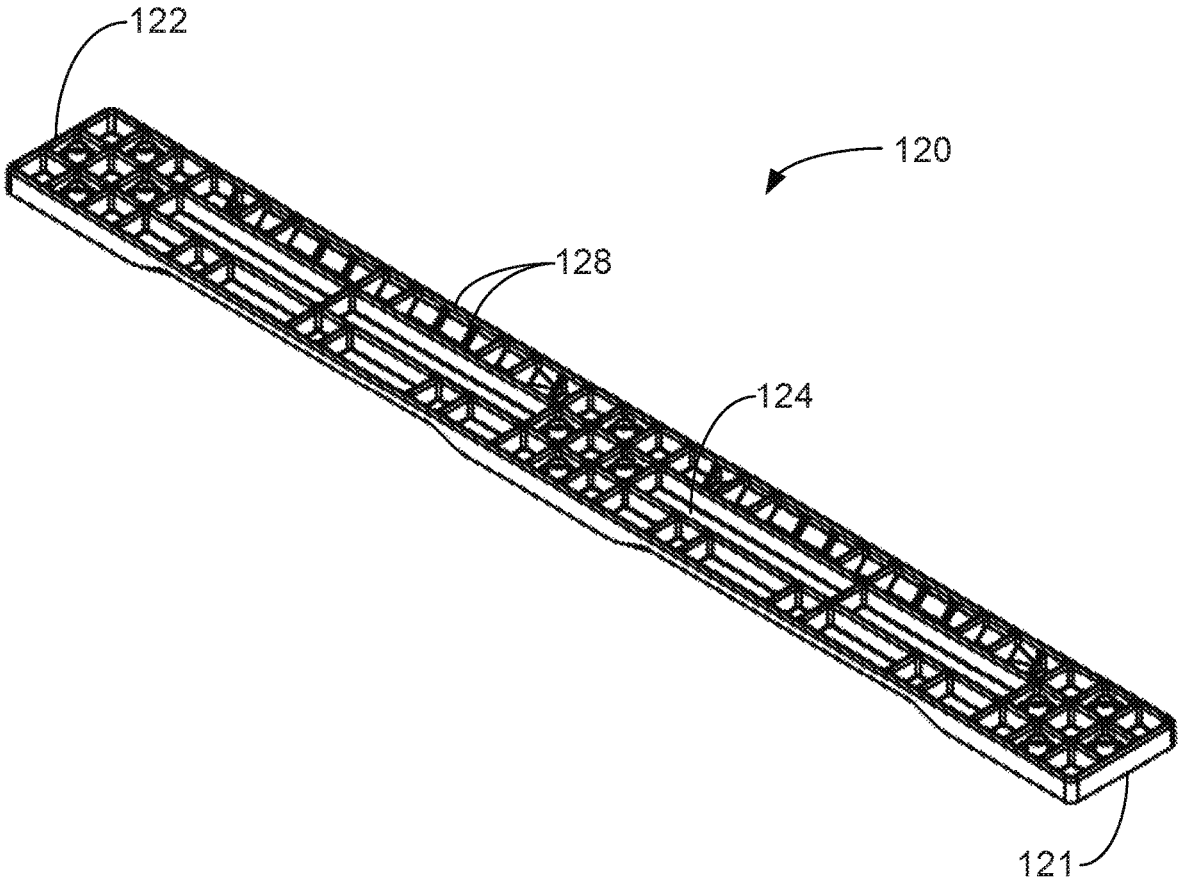
FIG. 4C is a bottom perspective view of the exemplary base member of FIG. 4A.

One exemplary base member 120 of the two or more base members 120 is shown in FIGS. 4A-4C. The base member 120 may define a first surface 123 and a second surface 124 opposite the first surface 123. Also, the base member 120 may extend between a first end 121 and a second end 142. The base member 140 may define a variety of different shapes and sizes. For example, the base member 120 may define a rectangular prism shape or a "board-like" shape. Specifically, the first and second surfaces 123, 124 of the base member 120 may define a major surface such that the surface areas of each of the first and second surfaces 123, 124 of the base member 120 are significantly larger than the other surfaces of the base member 120. For example, the length 131 of the base member 120 measured between the first end 121 and the second end 122 may be 40 inches (e.g., about 1.0 m). The width 133 of the base member 120 (e.g., along the first or second surface 123, 124 and perpendicular to the length 131) may be 4 inches (e.g., about 10 cm). The thickness of the base member 120 (e.g., perpendicular to both the length 131 and width 133, measured from first surface 133 to rib end portion 128) may be 0.75 inches (e.g., about 1.9 cm). Additionally, each of the base members 120 may weigh about greater than or equal to 1 pound, greater than or equal to 1.4 pounds, greater than or equal to 1.8 pounds, greater than or equal to 2 pounds, etc. and/or less than or equal to 5 pounds, less than or equal to 4 pounds, less than or equal to 3 pounds, less than or equal to 2.5 pounds, etc. More specifically, each of the base members 120 may weigh about 1.8 pounds to 2.5 pounds (e.g., for a base molding compound of about 40% to 50% long fiber thermoplastic).

Each base member 120 may include any combination of selective reinforcements (e.g., ribs, fiber dispersion, continuous fiber bundle, mesh, etc.) as described with respect to the intermediate member 140 herein. For example, as shown in FIGS. 4B and 4C, the base member 120 may include two or more ribs 126 that may extend away from the second surface 124 to a rib end portion 128 between the first and second ends 121, 122 of the base member 120. Also, the base member 120 may include fiber dispersed in a thermoplastic material and each of the two or more ribs 126 of the base member 120 may include a continuous fiber bundle (e.g., similar to the continuous fiber bundles 149 described with respect to the intermediate member 140). Furthermore, for example, the base member 120 may include a structural mesh positioned proximate the first surface 123 of the base member 120 to improve the structural rigidity of the base members 120. For example, any force applied towards the first surface 123 of the base member 120 (e.g., payload forcing down on the pallet 100) may be counteracted or resisted by the continuous fiber bundles in the two or more ribs 126 and any force applied towards the second surface 124 of the base member 120 (e.g., upward force due to tines or racks on which the pallet 100 is resting) may be counteracted or resisted by the structural mesh.

The base member 120 may also define a bevel 132 along the length 131 of the base member 120 between the first surface 123 and an adjacent side surface as shown in FIG. 4A. The bevel 132 may be described as a sloped surface or edge between the first surface 123 and the adjacent side surface. The base member 120 may have any number of bevels 131. For example, as shown in FIG. 4A, the base member 120 defines two bevels 132 on each side of the base member 120. The bevel 132 may be positioned at any location along the base member 120. For example, the bevel 132 may be lined up with any or all of the at least two discrete openings 105 shown in FIG. 1. The bevel 132 may allow for easy access by a material handling equipment such as "walkies" (e.g., manually operated lifting devices that roll up and over the base member 120 to access the middle of the pallet 100 through the at least two discrete openings 105).

As shown in FIGS. 1 and 2, the base member 120 is oriented such that the first surface 123 may be adjacent the support blocks 180 when the base member 120 is removably coupled to the support blocks 180. In some embodiments, the base member 120 may be "flipped" or rotated such that the two or more ribs 126 of the base member 120 may be adjacent the support blocks 180. In such embodiments, the support blocks 180 may include a protrusion (e.g., extending away from the second surface 184 of the support blocks 180) that may be received by a recess defined by the base member 120. In other words, a protrusion of the support block 180 and a recess of the base member 120 may interact to help position or locate the base member 120 relative to the support block 180 and provide the same benefits as discussed herein with respect to the intermediate member 140 (e.g., recesses 152) and the support blocks 180 (e.g., protrusions 185).

Figure 5A:
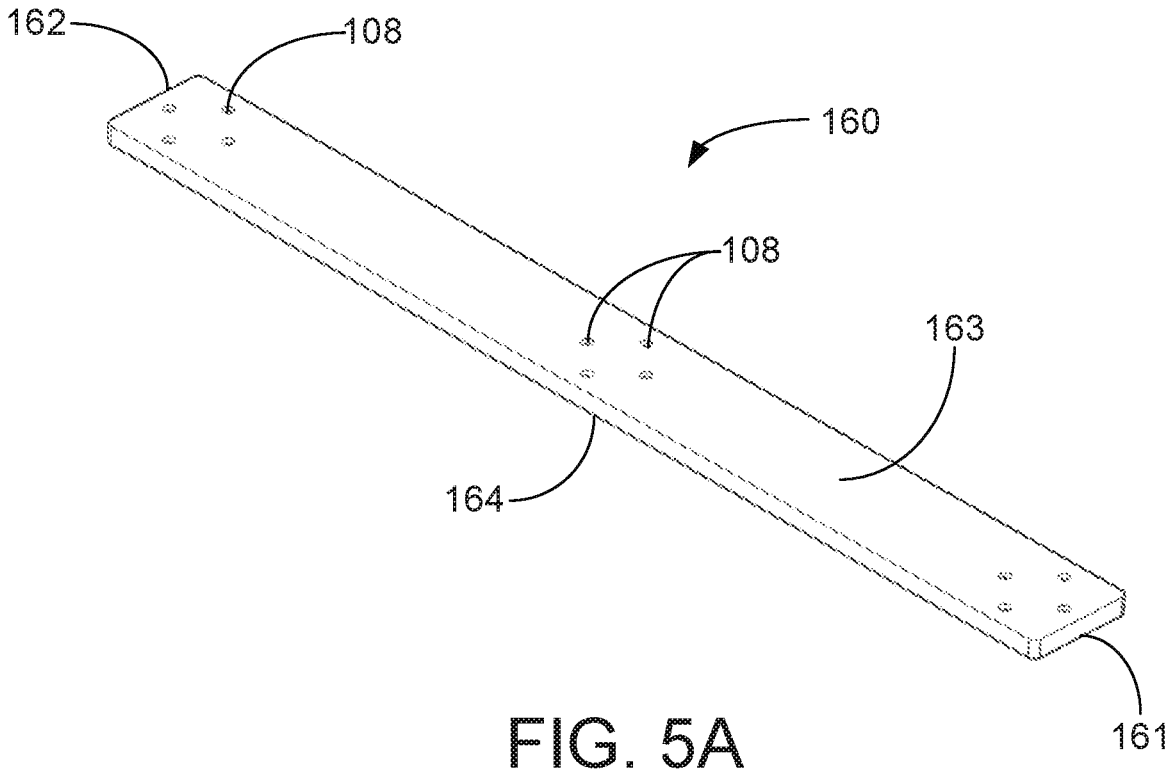
FIG. 5A is a top perspective view of an exemplary top outside member of the exemplary pallet of FIG. 1.
Figure 5B:
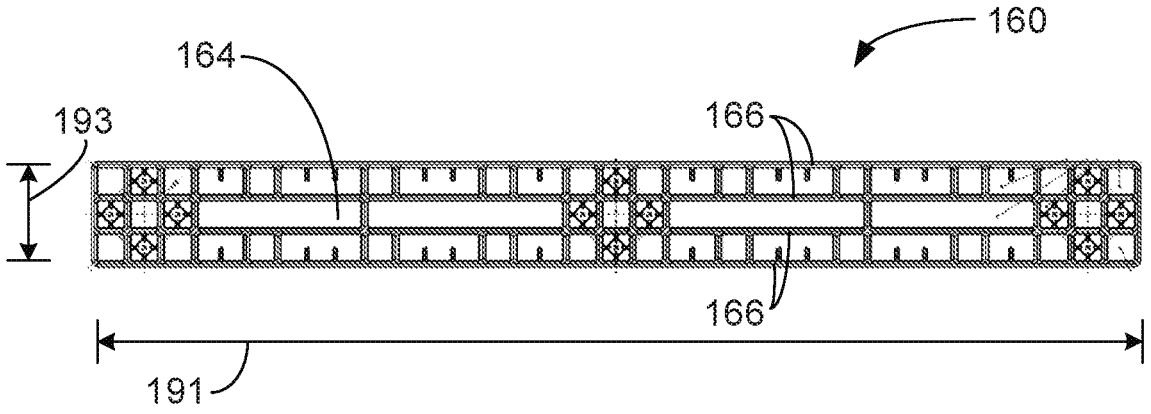
FIG. 5B is a bottom plan view of the exemplary top outside member of FIG. 5A.
Figure 5C:
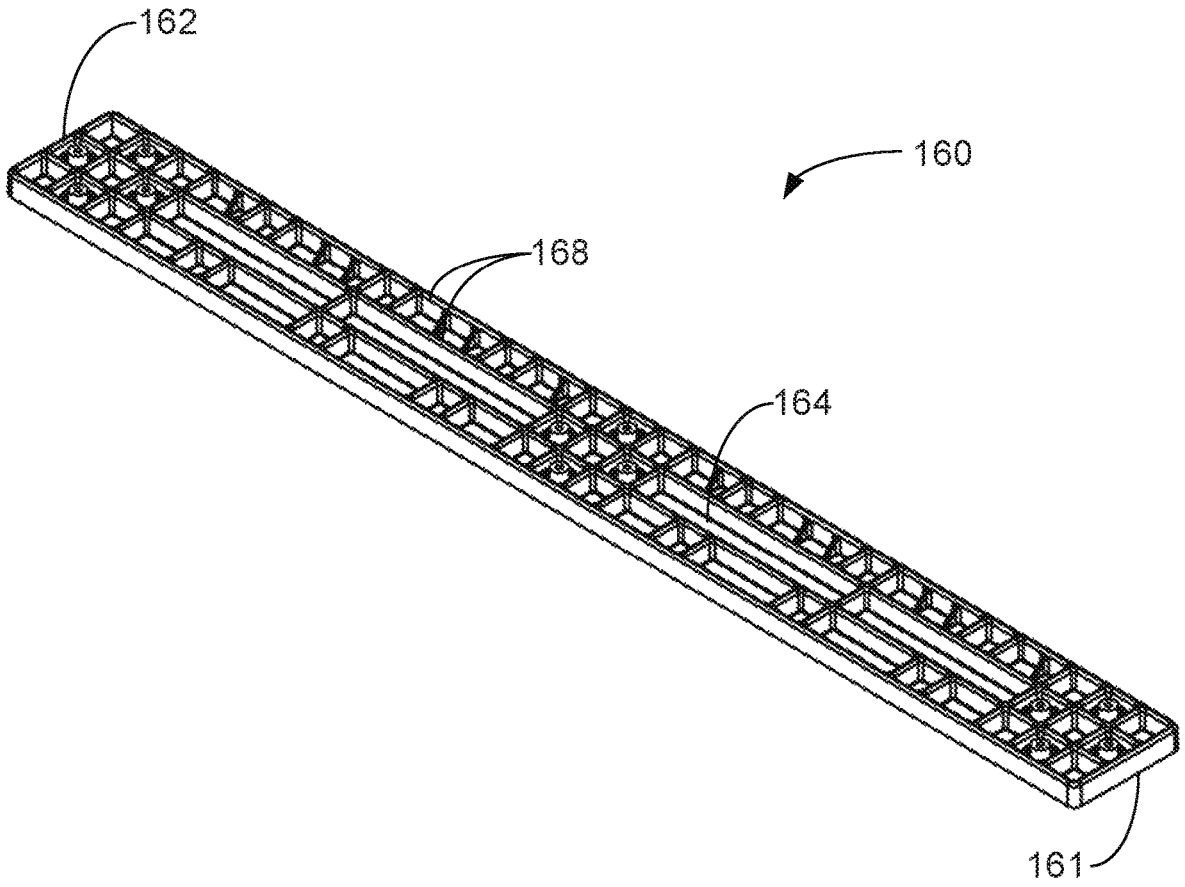
FIG. 5C is a bottom perspective view of the exemplary top outside member of FIG. 5A.

One exemplary top outside member 160 of the two top outside members 160 is shown in FIGS. 5A-5C. The top outside member 160 may define a first surface 163 and a second surface 164 opposite the first surface 163. Also, the top outside member 160 may extend between a first end 161 and a second end 162. The top outside member 160 may define a variety of different shapes and sizes. For example, the top outside member 160 may define a rectangular prism shape or a "board-like" shape. Specifically, the first and second surfaces 163, 164 of the top outside member 160 may define a major surface such that the surface areas of each of the first and second surfaces 163, 164 of the top outside member 160 are significantly larger than the other surfaces of the top outside member 160. For example, the length 191 of the top outside member 160 measured between the first end 161 and the second end 162 may be 40 inches (e.g., about 1.2 m). The width 193 of the top outside member 160 (e.g., along the first or second surface 163, 164 and perpendicular to the length 191) may be 4 inches (e.g., about 10 cm). The thickness of the top outside member 160 (e.g., perpendicular to both the length 191 and width 193, measured from first surface 163 to rib end portion 168) may be 0.75 inches (e.g., about 1.9 cm). Additionally, each of the top outside members 160 may weigh about greater than or equal to 1 pound, greater than or equal to 1.5 pounds, greater than or equal to 2 pounds, greater than or equal to 2.4 pounds, etc. and/or less than or equal to 5 pounds, less than or equal to 4 pounds, less than or equal to 3 pounds, less than or equal to 2.7 pounds, etc. More specifically, each of the top outside members 160 may weigh about 2 pounds to 2.7 pounds (e.g., for a base molding compound of about 40% to 50% long fiber thermoplastic).

Each top outside member 160 may include any combination of selective reinforcements (e.g., ribs, fiber dispersion, continuous fiber bundle, mesh, etc.) as described with respect to the intermediate member 140. For example, as shown in FIGS. 5B and 5C, the top outside member 160 may include two or more ribs 166 that may extend away from the second surface 164 to a rib end portion 168 between the first and second ends 161, 162 of the top outside member 160. Also, the top outside member 160 may include fiber dispersed in a thermoplastic material and each of the two or more ribs 166 of the top outside member 160 may include a continuous fiber bundle (e.g., similar to the continuous fiber bundles 149 described with respect to the intermediate member 140). The continuous fiber bundle located in each rib of the two or more ribs 166 may help to provide strength due to, e.g., forces or deflection caused by a payload that is located on one edge of the top outside member 160. In one or more embodiments, the ribs 166 located at the edge of the top outside member 160 may be thicker (and, e.g., containing a thicker continuous fiber bundle) to account for such an edge-racked loading. Furthermore, for example, the top outside member 160 may include an impact mesh positioned proximate the first surface 163 of the top outside member 160 to improve the impact resiliency of the top outside member 160. For example, any impact force applied on the first surface 163 of the top outside member 160 (e.g., payload dropped down on the pallet 100) may be deflected and absorbed by the impact mesh.

One exemplary top middle member 170 of the one or more top middle members 170 is shown in FIGS. 5A-5C. The top middle member 170 may define a first surface 173 and a second surface 174 opposite the first surface 173. Also, the top middle member 170 may extend between a first end 171 and a second end 172. The top middle member 170 may define a variety of different shapes and sizes. For example, the top middle member 170 may define a rectangular prism shape or a "board-like" shape. Specifically, the first and second surfaces 173, 174 of the top middle member 170 may define a major surface such that the surface areas of each of the first and second surfaces 173, 174 of the top middle member 170 are significantly larger than the other surfaces of the top middle member 170. For example, the length of the top middle member 170 measured between the first end 171 and the second end 172 may be 40 inches (e.g., about 1.0 m). The width of the top middle member 170 (e.g., along the first or second surface 173, 174 and perpendicular to the length) may be 4 inches (e.g., about 10 cm). The thickness of the top middle member 170 (e.g., perpendicular to both the length and width, measured from first surface 173 to the opposing edge) may be 0.75 inches (e.g., about 1.9 cm). Additionally, each of the top middle members 170 may weigh about greater than or equal to 0.5 pounds, greater than or equal to 1 pound, greater than or equal to 1.1 pounds, greater than or equal to 1.2 pounds, etc. and/or less than or equal to 4 pounds, less than or equal to 3 pounds, less than or equal to 2 pounds, less than or equal to 1.5 pounds, etc. More specifically, each of the top middle members 170 may weigh about 1.1 pounds to 1.5 pounds (e.g., for a base molding compound of about 40% to 50% long fiber thermoplastic).

The one or more top middle members 170 may include one large article or member that spans the space between the two top outside members 160 or multiple top middle members 170 (e.g., nine top middle members 170 as shown in FIG. 1) that are spaced across the top layer 165 of the pallet 100. The one or more top middle members 170 may be described as fill members or "non-structural" members because the one or more top middle members 170 may not necessarily include selective reinforcements similar to the structural members 110. However, in one or more embodiments, the top middle members 170 may include some selective reinforcements, e.g., the top middle members 170 may include two or more ribs 176 that may extend away from the second surface 174 to a rib end portion 178 between the first and second ends 171, 172 of the top middle member 170. In other embodiments, the top middle member 170 defines a rectangular cross-section that does not include any rib sections. Also, the top middle members 170 may include impact mesh, as described herein, to assist in impact resiliency and to, e.g., provide flexibility for sudden impact of payload or cargo dropped on the top middle members 170.

Additionally, the one or more top middle members 170 may define recesses 175 proximate the second surface 174 of the top middle members 170. The recesses 175 may be configured to locate and position the top middle members 170 relative to the intermediate members 140 by receiving the protrusions 154 of the intermediate member 140 when the intermediate member 160 is removably coupled to the top middle members 170.

Furthermore, the top middle members 170 may define apertures 108 configured to receive fasteners 109 such that the top middle members 170 may be removably coupled to the intermediate members 140.

The one or more top middle members 170 may include (e.g., be made of or formed of) a variety of different materials. For example, the one or more top middle members 170 may include a base molding compound including thermoplastic, thermoset, polyolefin, polypropylene, polyethylene, and/or high-density polyethylene. Specifically, the top middle members 170 may include high-density polyethylene because of its lower ignition point and propensity to drip less in a melted state (e.g., as compared to polypropylene). Also, the top middle members 170 may include no or low fiber dispersion reinforcement (e.g., as compared to structural members 110). For example, the top middle members 170 may include greater than or equal to 0% wt, greater than or equal to 5% wt, greater than or equal to 10% wt, greater than or equal to 15% wt, etc. and/or less than or equal to 30% wt, less than or equal to 25% wt, less than or equal to 20% wt, less than or equal to 17% wt, etc. of reinforced materials (e.g., long or short fiber).

The pallet 100 may also include a plurality of support blocks 180 that may be positioned to separate the base layer 125 from the intermediate layer 145 and the top layer 165 to define at least two discrete openings 105 so that the pallet 100 may be moved and/or lifted. Each of the support blocks 180 may define a first surface 183 and a second surface 184 opposite the first surface 183. In one or more embodiments, the support blocks 180 include protrusions 185 (e.g., castles) extending from the first surface 183 of the support block 180. The protrusions 185 of the support blocks 180 may be any size or shape (e.g., circular, rectangular, triangular, square, etc.). The protrusions 185 may be configured to be inserted into recesses (e.g., recesses 152 of the intermediate members 140) to help locate the intermediate members 140 relative to the support blocks and strengthen the pallet 100 as further described herein. In some embodiments, the support blocks 180 may include protrusions 185 extending from the second surface 184 of the support blocks 180. Protrusions 185 of the support blocks 180 extending from the second surface 184 may interface with the base members 120 in an embodiment in which the base members 120 are rotated such that recesses of the base members 120 are adjacent the protrusions 185 of the support blocks 180.

The support blocks 180 may include (e.g., be made of or formed of) a variety of different materials. For example, the support blocks 180 may include a base molding compound including thermoplastic, thermoset, polyolefin, polypropylene, polyethylene, and/or high-density polyethylene. Specifically, the support blocks 180 may include high-density polyethylene. Also, the support blocks 180 may include no or low fiber dispersion reinforcement. For example, the top middle members 170 may include greater than or equal to 0% wt, greater than or equal to 5% wt, greater than or equal to 10% wt, greater than or equal to 15% wt, etc. and/or less than or equal to 30% wt, less than or equal to 25% wt, less than or equal to 20% wt, less than or equal to 17% wt, etc. of glass reinforced materials (e.g., long or short fiber). In one or more embodiments, the support blocks 180 may include a different material than the structural members 110 (e.g., base members 120, intermediate members 140, top outside members 160). For example, the structural members 110 may include a first thermoplastic material and the support blocks 180 may include a second thermoplastic material; and the first thermoplastic material may be a different type of thermoplastic material than the second thermoplastic material.

Figure 7:
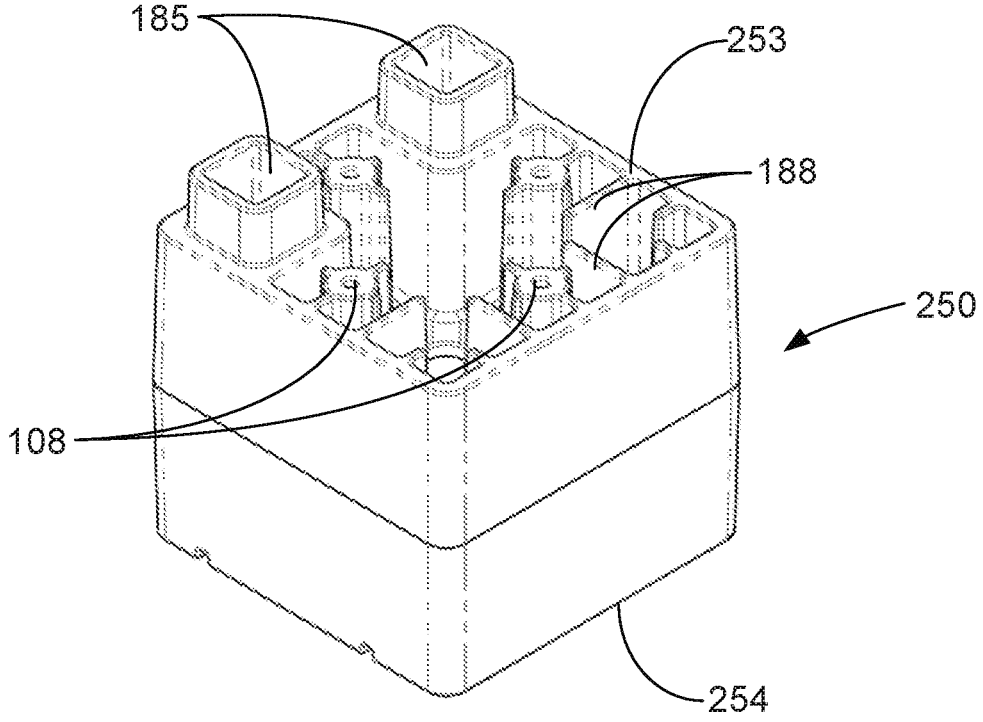
FIG. 7 is a top perspective view of an exemplary middle block of the exemplary pallet of FIG. 1.
Figure 8:
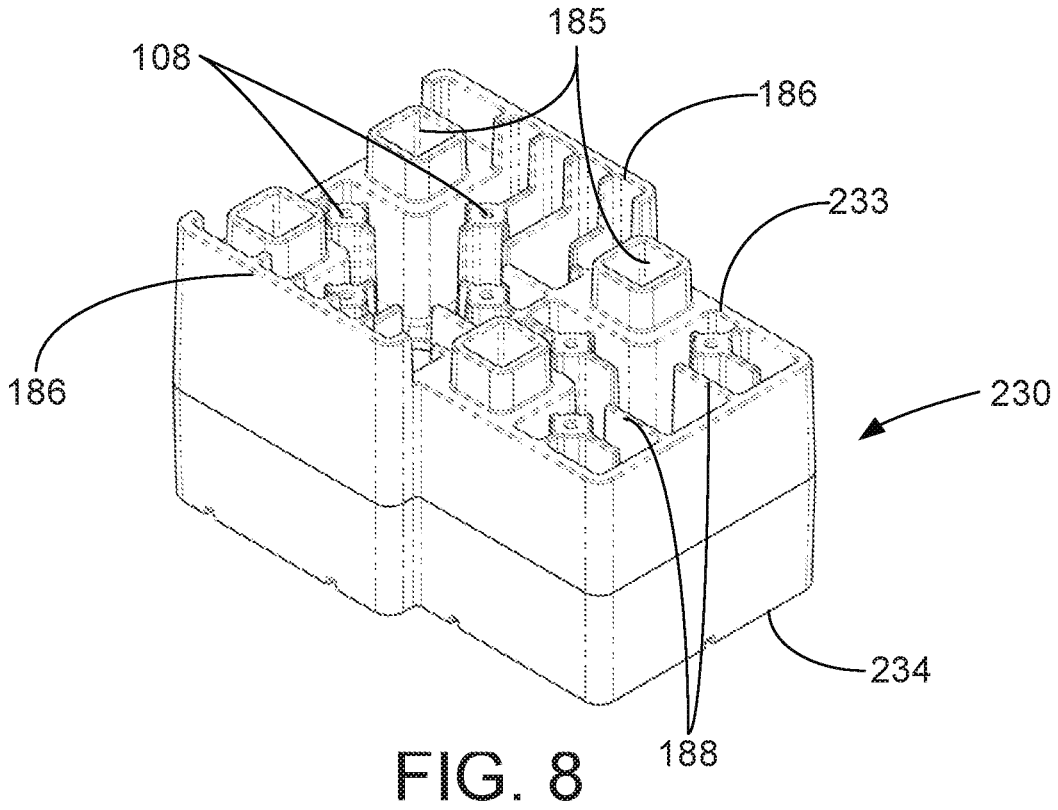
FIG. 8 is a top perspective view of an exemplary center block of the exemplary pallet of FIG. 1.
Figure 9:
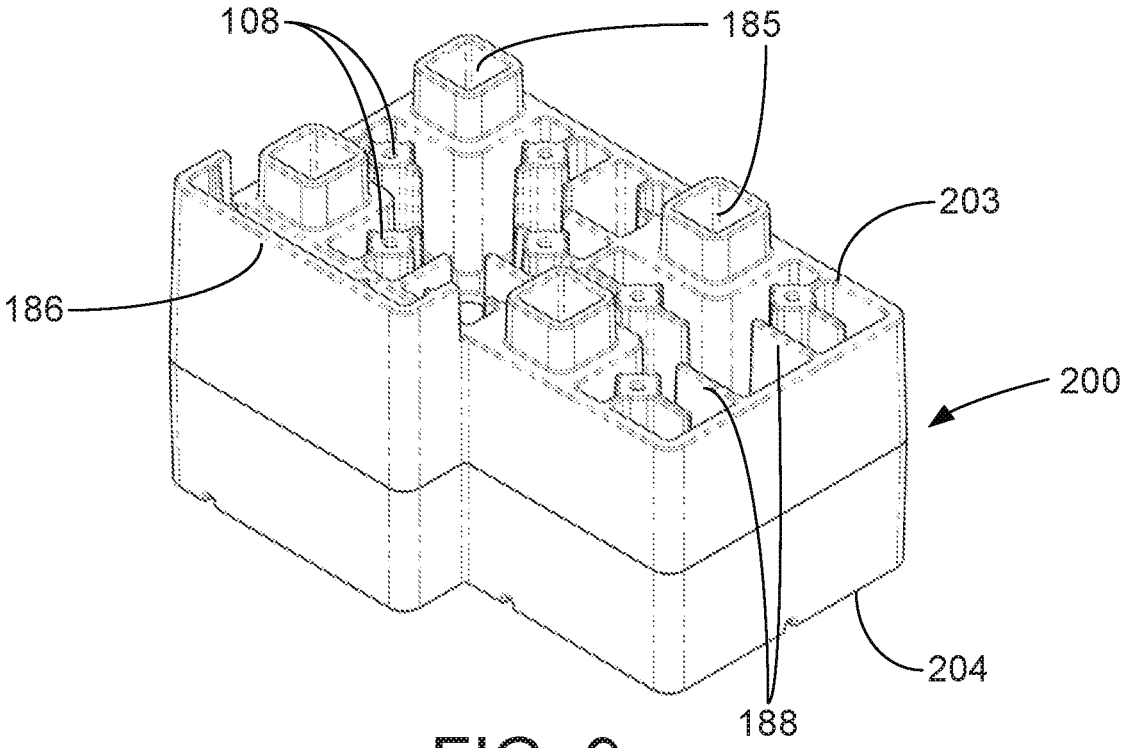
FIG. 9 is a top perspective view of an exemplary corner block of the exemplary pallet of FIG. 1.
Figure 10:
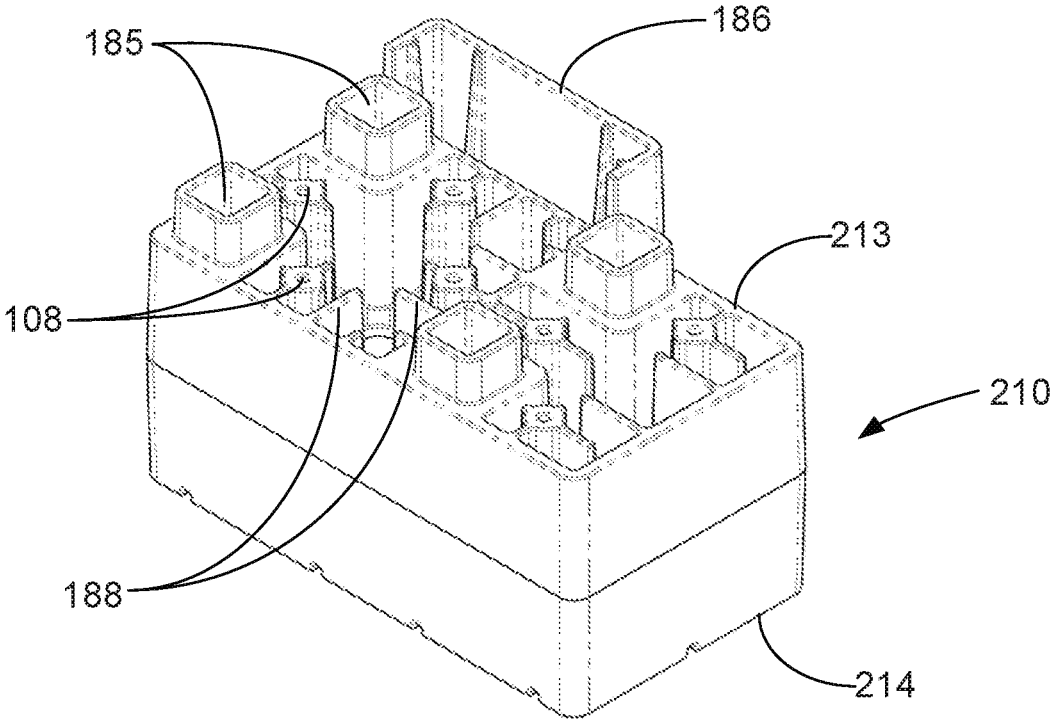
FIG. 10 is a top perspective view of another exemplary corner block of the exemplary pallet of FIG. 1.

In some embodiments, the support blocks 180 may be solid throughout or hollow through the middle, however, as shown in FIGS. 7-10, the support blocks 180 may include support ribs 188 extending for at least a portion between the first and second surfaces 183, 184 of the support blocks 180. The support ribs 188 of the support blocks 180 may be positioned to provide specific rigidity and resilience/flexibility to the support blocks 180. For example, the support blocks 180 may often be impacted or jabbed by tines of a lifting device (e.g., to better position the pallet 100 for lifting). The support ribs 188 of the support blocks 180 and the high-density polyethylene composition may help provide pliability to help counter the sudden impacts. The support blocks 180 may also include one or more alignment walls 186 as shown in FIGS. 8-10. The alignment walls 186 may help to align the intermediate member 140 positioned on the support block 180 and may help to support the top outside members 160 (e.g., by increasing the surface area on which the top outside member 160 rests). Also, the support blocks 180 define apertures 108 that are configured to receive fasteners 109 so that the intermediate members 140, base members 120, top outside members 160, and top middle members 170 may be removably coupled to the support blocks 180. Additionally, an impact mesh may be embedded in the support blocks 180 to also provide increased flexibility.

The plurality of support blocks 180 may include a variety of different types of support blocks 180 as shown in FIGS. 7-10. For example, FIG. 7 illustrates a middle block 250 defining a first surface 253 and a second surface 254 opposite the first surface 253. The middle block 250 may be positioned at a center point of each intermediate member 140 and the middle block 250 may be removably coupled to the intermediate member 140 (e.g., with the interface proximate the first surface 253 of the middle block 250 and the second surface 144 of the intermediate member 140) and may be removably coupled to the base member 120 (e.g., with the interface proximate the second surface 254 of the middle block 250 and the first surface 123 of the base member 120).

FIG. 8 illustrates a center block 230 defining a first surface 233 and a second surface 234 opposite the first surface 233. The center blocks 230 may be positioned on the first and second ends 141, 142 of the intermediate member 140 located not along the edges (e.g., the intermediate inside member). The center blocks 230 may be removably coupled to the intermediate member 140 (e.g., with the interface proximate the first surface 233 of the center blocks 230 and the second surface 144 of the intermediate member 140) and may be removably coupled to the base member 120 (e.g., with the interface proximate the second surface 234 of the center blocks 230 and the first surface 123 of the base member 120). The center blocks 230 may include two alignment walls 186 for the intermediate member 140 to be positioned in between.

FIGS. 9 and 10 illustrate two different embodiments of corner blocks 200, 210 that may define a first surface 203, 213 and a second surface 204, 214 opposite the first surface 213, 214. The corner blocks 200, 210 may be positioned in the corners of the pallet 100 on the first and second ends 141, 142 of the intermediate members 140 located along the edges (e.g., the intermediate outside members). The corner blocks 200, 210 may be removably coupled to the intermediate member 140 (e.g., with the interface proximate the first surface 203, 213 of the corner blocks 200, 210 and the second surface 144 of the intermediate member 140) and may be removably coupled to the base member 120 (e.g., with the interface proximate the second surface 204, 214 of the corner blocks 200, 210 and the first surface 123 of the base member 120). The corner blocks 200, 210 may include one alignment wall 186 for the intermediate member 140 to be positioned against. The alignment wall 186 of the corner blocks 200, 210 may be positioned such that the alignment wall 186 may also be located on the inside of the pallet 100 closest to the at least two discrete openings 105 (e.g., away from the edges of the pallet 100) to provide increased surface area support to the top outside members 160.

The exemplary pallet 100 described herein may also include a flame retardant within the base molding compound. For example, each of the base members 120, intermediate members 140, top outside members 160, top middle members 170, and support blocks 180 may include some degree of flame retardant (e.g., to meet National Fire Protection Association fire retardant requirements). Specifically, the flame retardant used in the pallet 100 may be a non-halogenated, non-brominated food-contact-safe fire retardant that may be compliant with U.S. Food and Drug Administration regulations.

The amount of flame retardant used in the structural members 110 may be about 0% to 10% of the base wt flame retardant. Typically the amount of flame retardant in a pallet may be about 30% to 40% of the base wt flame retardant. The lower amount of flame retardant may be included for a variety of reasons. For example, the flame retardant may provide a negative impact on performance that may counter act the increased performance of the selective reinforcements, the lower amount of flame retardant may improve moldability of the base molding compound (as compared to a higher flame retardant percentage), etc. The top middle members 170 may include about 5% to 15% of the base wt flame retardant. In one or more embodiments, the two or more ribs may include a different base wt percent flame retardant than the rest of the member from which the ribs extend. The support blocks 180 generally may include about 0% to 15% wt of the base flame retardant. Specifically, the center blocks 230 and middle blocks 250 may include about 0% to 10% of the base wt flame retardant, and the corner blocks 200, 210 may include about 5% to 15% of the base wt flame retardant. The corner blocks 200, 210 may include a higher wt percentage of flame retardant additive because the corners of the pallet 100 may be more exposed to potential fire.

Furthermore, the pallet 100 may define openings (e.g., at the top layer 165 and/or within the top middle members 170) to form a certain amount of open surface area to allow for, e.g., easier handling and increased water resonance during a fire (as compared to no or minimal open surface area). For example, the top layer 165 may define at least 10% to 20% surface area that may be open.

The exemplary pallet 100 described herein may also be described as components of a kit. For example, the kit may include all of the elements described herein as being configured to be removably coupled to assemble a pallet 100. Specifically, the kit may include, e.g., structural members 110 (e.g., base members 120, intermediate members 140, top outside members 160), top middle members 170, support blocks 180, fasteners 109, etc.

Thus, embodiments of COMPOSITE PALLETS are disclosed.

All references and publications cited herein are expressly incorporated herein by reference in their entirety into this disclosure, except to the extent they may directly contradict this disclosure. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof. The disclosed embodiments are presented for purposes of illustration and not limitation.

What is claimed is:

1. A composite pallet, comprising:

a plurality of base boards including a first base board and a second base board;

a plurality of support blocks coupled to the plurality of base boards, the plurality of support blocks including a first support block;

wherein the first support block is detachably connected to the first base board, is detachably connected to the second base board, and secures the first base board to the second base board;

wherein the first support block includes a first section with a first width and a second section with a second width different from the first width;

a plurality of intermediate boards coupled to the plurality of support blocks;

a plurality of top boards coupled to the plurality of intermediate boards;

wherein the plurality of top boards include a top outside board, the top outside board comprising a thermoplastic material, a rib, and a tension member disposed within the rib and positioned adjacent to an end portion of the rib; and wherein the tension member includes a continuous fiber bundle.

2. The composite pallet of claim 1, wherein the first support block is detachably connected to the first base board with one or more fasteners.

3. The composite pallet of claim 1, wherein the plurality of intermediate boards includes a first intermediate board, wherein the first intermediate board includes a plurality of sockets, and wherein the first support block includes a plurality of protrusions configured to engage the plurality of sockets.

4. The composite pallet of claim 1, wherein the second width is smaller than the first width.

5. The composite pallet of claim 4, wherein the first base board has a third width and wherein the first width is greater than the third width.

6. The composite pallet of claim 5, wherein the second width is substantially equal to the third width.

7. The composite pallet of claim 1, wherein the thermoplastic material includes polypropylene.

8. The composite pallet of claim 1, wherein the top outside board includes an impact member disposed along a top portion thereof.

9. The composite pallet of claim 8, wherein the impact member includes an open mesh.

10. The composite pallet of claim 1, wherein a plurality of glass fibers having an average length of 1 to 15 millimeters are dispersed in the top outside board.

11. The composite pallet of claim 1, wherein a plurality of glass fibers having an average length of 2 to 12 millimeters are dispersed in the top outside board.

12. A composite pallet, comprising:

a plurality of base boards including a first base board and a second base board;

a plurality of support blocks coupled to the plurality of base boards, the plurality of support blocks including a first support block;

wherein at least a portion of the first support block has a width greater than a width of the first base board;

wherein the first support block is detachably connected to the first base board, is detachably connected to the second base board, and secures the first base board to the second base board;

a plurality of intermediate boards coupled to the plurality of support blocks, the plurality of intermediate boards including a first intermediate board;

wherein the first intermediate board includes a first rib;

a first tension member disposed within the first rib and positioned adjacent to a first end portion of the first rib;

a plurality of top boards coupled to the plurality of intermediate boards, the plurality of top boards including a top outside board;

wherein the top outside board includes a second rib;

a second tension member disposed within the second rib and positioned adjacent to a second end portion of the second rib; and wherein the first tension member, the second tension member, or both include a continuous fiber bundle.

13. The composite pallet of claim 12, wherein the first intermediate board includes one or more bosses projected from a top portion of the first intermediate board.

14. The composite pallet of claim 12, wherein a plurality of glass fibers having an average length of 1 to 15 millimeters are dispersed in the top outside board.

15. The composite pallet of claim 12, wherein a plurality of glass fibers having an average length of 2 to 12 millimeters are dispersed in the top outside board.

16. A composite pallet, comprising:

a plurality of base boards including a first base board, a second base board, a third base board, and a fourth base board;

a plurality of support blocks coupled to the plurality of base boards, the plurality of support blocks including a first support block, a second support block, a third support block, and a fourth support block;

wherein the second support block is different from the first support block;

wherein the third support block is different from the first support block and the second support block;

wherein the fourth support block is different from the first support block, the second support block, and the third support block;

wherein the first support block is detachably connected to the first base board, is detachably connected to the second base board, and secures the first base board to the second base board;

wherein the first support block includes a plurality of projections extending from a top surface thereof;

wherein the second support block is detachably connected to the second base board and is free from attachment to any other of the plurality of base boards;

wherein the third support block is detachably connected to the second base board, is detachably connected to the third base board, and secures the second base board to the third base board;

wherein the fourth support block is detachably connected to the third base board, is detachably connected to the fourth base board, and secures the third base board to the fourth base board;

a plurality of intermediate boards coupled to the plurality of support blocks, the plurality of intermediate boards including a first intermediate board;

wherein the first intermediate board includes a first rib;

a first tension member disposed within the first rib and positioned adjacent to a first end portion of the first rib, the first tension member including a first continuous fiber bundle;

a plurality of top boards coupled to the plurality of intermediate boards, the plurality of top boards including a top outside board;

wherein the top outside board includes a second rib; and a second tension member disposed within the second rib and positioned adjacent to a second end portion of the second rib, the second tension member including a second continuous fiber bundle.

17. The composite pallet of claim 16, wherein the first support block includes a first section having a first width and a second section having a second width that is smaller than the first width.

18. The composite pallet of claim 17, wherein the first base board has a third width and wherein the first width is greater than the third width.

19. The composite pallet of claim 18, wherein the second width is substantially equal to the third width.

20. The composite pallet of claim 16, wherein the top outside board includes an impact member disposed along a top portion thereof.

* * * * *